US009930434B2

(12) United States Patent
Domash

(10) Patent No.: US 9,930,434 B2
(45) **Date of Patent: *Mar. 27, 2018**

(54) VISUAL AND/OR ACOUSTIC PRIVACY FEATURES

(71) Applicant: Domash Design Source LLC, Webster Groves, MO (US)

(72) Inventor: Kenneth Niles Domash, Wildwood, MO (US)

(73) Assignee: Domash Design Source LLC, Webster Groves, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/269,484

(22) Filed: Sep. 19, 2016

(65) Prior Publication Data

US 2017/0006367 A1 Jan. 5, 2017

Related U.S. Application Data

(63) Continuation of application No. 14/500,647, filed on Sep. 29, 2014, now Pat. No. 9,449,591, which is a (Continued)

(51) Int. Cl.
*A47C 7/62* (2006.01)
*H04R 1/02* (2006.01)

(Continued)

(52) U.S. Cl.
CPC ..... *H04R 1/026* (2013.01); *A47B 97/00* (2013.01); *A47C 7/38* (2013.01); *A47C 7/62* (2013.01);

(Continued)

(58) Field of Classification Search
CPC .... A47C 7/72; A47C 7/62; A47C 7/38; H04R 1/026; G10K 11/16; E06B 9/00; A47B 97/00

(Continued)

(56) References Cited

U.S. PATENT DOCUMENTS 1,692,337 A 11/1928 Forbes
2,359,895 A 10/1944 Burton (Continued)

FOREIGN PATENT DOCUMENTS

JP 62211010 9/1987
JP 05137630 B2 2/2013

OTHER PUBLICATIONS

Joon Soo Kim's Little Privacy Hand on Chair; www.decodir.com; Dec. 14, 2012; 3 pgs.

(Continued)

*Primary Examiner* — Chi Q Nguyen

(74) *Attorney, Agent, or Firm* — Harness, Dickey & Pierce, P.L.C.

(57) ABSTRACT

Disclosed are exemplary embodiments of visual and/or acoustic privacy features. For example, exemplary embodiments are disclosed that include visual and/or acoustic privacy features for furniture (e.g., office chair, desk, table, cubicle, etc.). The visual and/or acoustic privacy features are movable relative to the user and/or furniture between at least a first configuration and a second configuration. In the first configuration, the visual and/or acoustic privacy features may be configured such that they do not inhibit the user from interacting with others. In the second configuration, the visual and/or acoustic privacy features may be configured to provide the user with at least some visual and/or acoustic privacy and isolation from others.

20 Claims, 34 Drawing Sheets

Related U.S. Application Data continuation-in-part of application No. 14/062,318, filed on Oct. 24, 2013, now Pat. No. 8,845,016.

(60) Provisional application No. 61/718,298, filed on Oct. 25, 2012, provisional application No. 61/813,851, filed on Apr. 19, 2013, provisional application No. 61/888,890, filed on Oct. 9, 2013.

(51) Int. Cl.

| | |
|---|---|
| ***E06B 9/00*** | (2006.01) |
| ***A47B 97/00*** | (2006.01) |
| ***A47C 7/72*** | (2006.01) |
| ***A47C 7/38*** | (2006.01) |
| ***G10K 11/16*** | (2006.01) |

(52) U.S. Cl.
CPC ..... *A47C 7/72* (2013.01); *E06B 9/00* (2013.01); *G10K 11/16* (2013.01)

(58) Field of Classification Search
USPC ..... 297/184.15, 217.4; 248/123.11, 125.9, 248/154, 125.7
See application file for complete search history.

(56) References Cited

U.S. PATENT DOCUMENTS

| | | | |
|---|---|---|---|
| 2,582,571 | A | 1/1952 | Thoma |
| 3,384,719 | A | 5/1968 | Lanzara |
| 3,762,767 | A | 10/1973 | Powell |
| 3,883,202 | A | 5/1975 | Konig |
| 3,976,162 | A | 8/1976 | Cummings |
| 4,205,878 | A | 6/1980 | Wooten |
| 4,440,443 | A | 4/1984 | Nordskog |
| 4,826,245 | A | 5/1989 | Entratter |
| 5,116,011 | A | 5/1992 | Smith |
| 5,231,562 | A | 7/1993 | Pierce et al. |
| 5,333,665 | A | 8/1994 | Safar |
| 5,441,067 | A | 8/1995 | James et al. |
| 5,564,784 | A | 10/1996 | Felling |
| 5,629,156 | A | 5/1997 | Shah et al. |
| 5,795,018 | A | 8/1998 | Schumacher et al. |
| 5,807,177 | A | 9/1998 | Takemoto et al. |
| 5,997,091 | A | 12/1999 | Rech et al. |
| 6,092,868 | A | 7/2000 | Wynn |
| 6,120,099 | A | 9/2000 | Reiker.ang.s et al. |
| 6,152,567 | A | 11/2000 | LaForgia |
| 6,170,410 | B1 | 1/2001 | Gioacchini et al. |
| 6,179,263 | B1 | 1/2001 | Rosen et al. |
| 6,206,464 | B1 | 3/2001 | Santa Rosa et al. |
| 6,220,668 | B1 | 4/2001 | Scheffzuck |
| 6,234,446 | B1 | 5/2001 | Patterson |
| 6,283,043 | B1 | 9/2001 | Stern et al. |
| 6,305,749 | B1 | 10/2001 | O'Connor et al. |
| 6,354,044 | B1 | 3/2002 | Lagace, Jr. |
| 6,485,154 | B1 | 11/2002 | Nolan-Brown |
| 6,569,789 | B1 | 5/2003 | Shioda et al. |
| 6,571,907 | B2 | 6/2003 | Jennings |
| 6,644,736 | B2 | 11/2003 | Nguyen et al. |
| 6,679,612 | B1 | 1/2004 | West et al. |
| 6,682,143 | B2 | 1/2004 | Amirault et al. |
| 6,695,270 | B1 | 2/2004 | Smed |
| 6,712,433 | B2 | 3/2004 | Hellwig et al. |
| 6,725,784 | B2 | 4/2004 | Crinion |
| 6,744,898 | B1 | 6/2004 | Hirano |
| 6,764,133 | B2 | 7/2004 | Osato |
| 6,916,065 | B2 | 7/2005 | Park |
| 7,125,074 | B2 | 10/2006 | Real et al. |
| 7,134,719 | B2 | 11/2006 | Moglin et al. |
| D539,572 | S | 4/2007 | Nguyen |
| 7,347,492 | B2 | 3/2008 | DiRe |
| 7,364,239 | B2 | 4/2008 | Clough |
| 7,530,538 | B2 | 5/2009 | Whalen et al. |
| 7,611,252 | B1 | 11/2009 | Lin |
| 8,070,114 | B2 | 12/2011 | Chen |
| 8,091,961 | B2 | 1/2012 | Dryburgh |
| 8,295,535 | B2 | 10/2012 | Tracy |
| 8,845,016 | B2 | 9/2014 | Domash |
| 9,449,591 | B2 * | 9/2016 | Domash ..... A47C 7/38 |
| 2001/0026087 | A1 | 10/2001 | Tomita |
| 2002/0073900 | A1 | 6/2002 | Birsel et al. |
| 2003/0015632 | A1 | 1/2003 | Dunn et al. |
| 2003/0057749 | A1 | 3/2003 | Buono |
| 2003/0146654 | A1 | 8/2003 | Nguyen et al. |
| 2003/0197405 | A1 | 10/2003 | Stoline-Litwin |
| 2004/0140066 | A1 | 7/2004 | Brennan |
| 2005/0006542 | A1 | 1/2005 | Henning et al. |
| 2005/0067866 | A1 | 3/2005 | Luong |
| 2005/0168021 | A1 | 8/2005 | Real et al. |
| 2005/0263041 | A1 | 12/2005 | Mueller et al. |
| 2007/0010084 | A1 | 1/2007 | Fischer et al. |
| 2007/0035164 | A1 | 2/2007 | North |
| 2009/0139669 | A1 | 6/2009 | Robin |
| 2009/0146033 | A1 | 6/2009 | Chiang |
| 2009/0206641 | A1 | 8/2009 | Brown, Jr. |
| 2010/0289315 | A1 | 11/2010 | Jackson |
| 2010/0327129 | A1 | 12/2010 | Chen |
| 2011/0156598 | A1 | 6/2011 | Li |
| 2011/0303805 | A1 | 12/2011 | Lau et al. |
| 2013/0161466 | A1 | 6/2013 | Lau et al. |

OTHER PUBLICATIONS

Hush; www.gizmag.com; Aug. 7, 2012; 3 pgs.
www.ciselect.com/furniture; Oct. 25, 2012; 6 pgs.
MMQB, The Business of Furniture; Oct. 29, 2012; 6 pgs.
Hush Pod; www.asensiblehabit.com; Aug. 7, 2012; 3 pgs.
Eclipse Office Partition System: Ergonomic Office Furniture, Modern and Flexible by Marcus Ward Curran; www.wanelo.com; Oct. 23, 2013; 1 pg.
Eclipse Office Partition System by Marcus Ward Curran; www.designlaunches.com; Oct. 23, 2013; 2 pgs.
http://www.morfae.com/0876-huberti; Armchairs and Lounge Chairs; by Benjamin Hubert; Aug. 7, 2012; 3 pgs.
http://www.trendhunter.com/slideshow/privacy-encouraging-office-furniture; Oct. 24, 2013; 14 pages.
http://www.google.com/imgres?start=194&sa=X&rls=com.microsoft;en-us;IE-Sea-rchBox&rlz=1|7.sub.--en&biw-1014&bih=. . . Freedom' seating concept packs eve . . . www.engadget.com; Oct. 24, 2013; 1 page.
http://www.hermanmiller.com/MarketFacingTech/hmc/solution_essays/assets/se_Sound_Masking_in_the_Office.pdf, Sound Masking in the Office; Copyright 2003, 6 pages.

* cited by examiner

VISUAL AND/OR ACOUSTIC PRIVACY FEATURES

CROSS-REFERENCE TO RELATED APPLICATIONS

This application is a continuation-in-part of allowed U.S. patent application Ser. No. 14/500,647 filed Sep. 29, 2014 (published as US2015/0016651 on Jan. 15, 2015, now U.S. Pat. No. 9,449,591 issued Sep. 20, 2016) which, in turn, is a continuation-in-part of U.S. patent application Ser. No. 14/062,318 filed Oct. 24, 2013, now U.S. Pat. No. 8,845,016 issued Sep. 30, 2014, which, in turn, claims the benefit and priority of U.S. Provisional Application No. 61/718,298 filed Oct. 25, 2012, U.S. Provisional Application No. 61/813,851 filed Apr. 19, 2013, and U.S. Provisional Application No. 61/888,890 filed Oct. 9, 2013. The entire disclosures of the above applications are incorporated herein by reference.

BACKGROUND

This section provides background information related to the present disclosure which is not necessarily prior art.

Some office environments are very open with many people sitting in cubicles or other work stations without full walls, doors, etc. between the work stations. In such open office environments, there is little to no office privacy such that it is commonplace for neighboring workers to overhear each other's telephone conversations. Privacy may also be hard to find in other open areas, such as in schools, restaurants, cafeterias, airport terminals, testing centers, libraries, home offices, etc.

SUMMARY

This section provides a general summary of the disclosure, and is not a comprehensive disclosure of its full scope or all of its features.

Disclosed are exemplary embodiments of visual and/or acoustic privacy features. For example, exemplary embodiments are disclosed that include visual and/or acoustic privacy features for furniture (e.g., office chair, desk, table, cubicle, etc.). The visual and/or acoustic privacy features are movable relative to the user and/or furniture between at least a first configuration and a second configuration. In the first configuration, the visual and/or acoustic privacy features may be configured such that they do not inhibit the user from interacting with others. In the second configuration, the visual and/or acoustic privacy features may be configured to provide the user with at least some visual and/or acoustic privacy and isolation from others.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 1, 2, and 3 are perspective views showing visual and/or acoustic privacy features mounted to and/or supported by a desk according to an exemplary embodiment, where the visual and/or acoustic privacy features are respectively shown in a first configuration (FIG. 1), a second configuration (FIG. 2), and a third configuration (FIG. 3);

Figure 17:
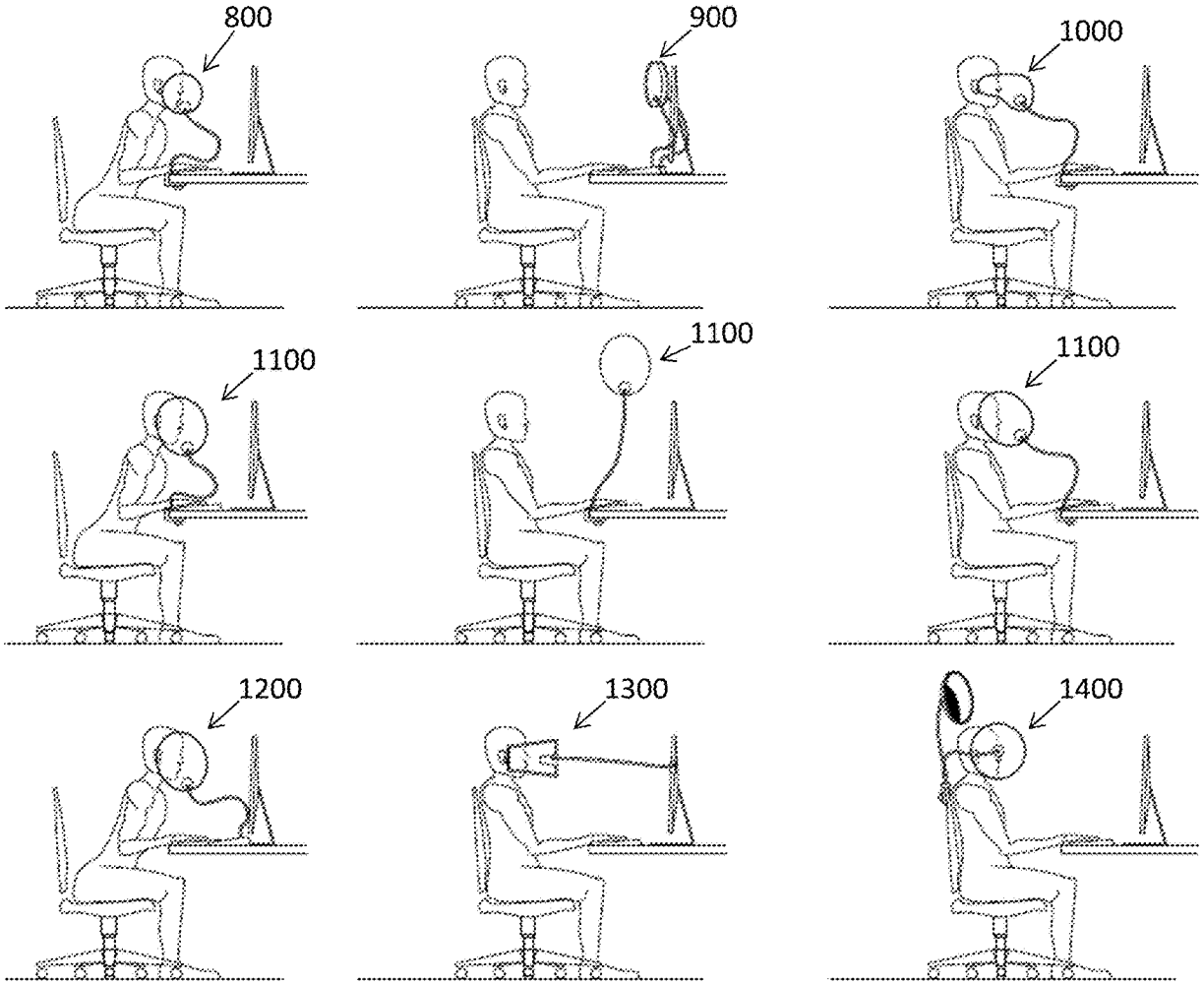
Figure 18:
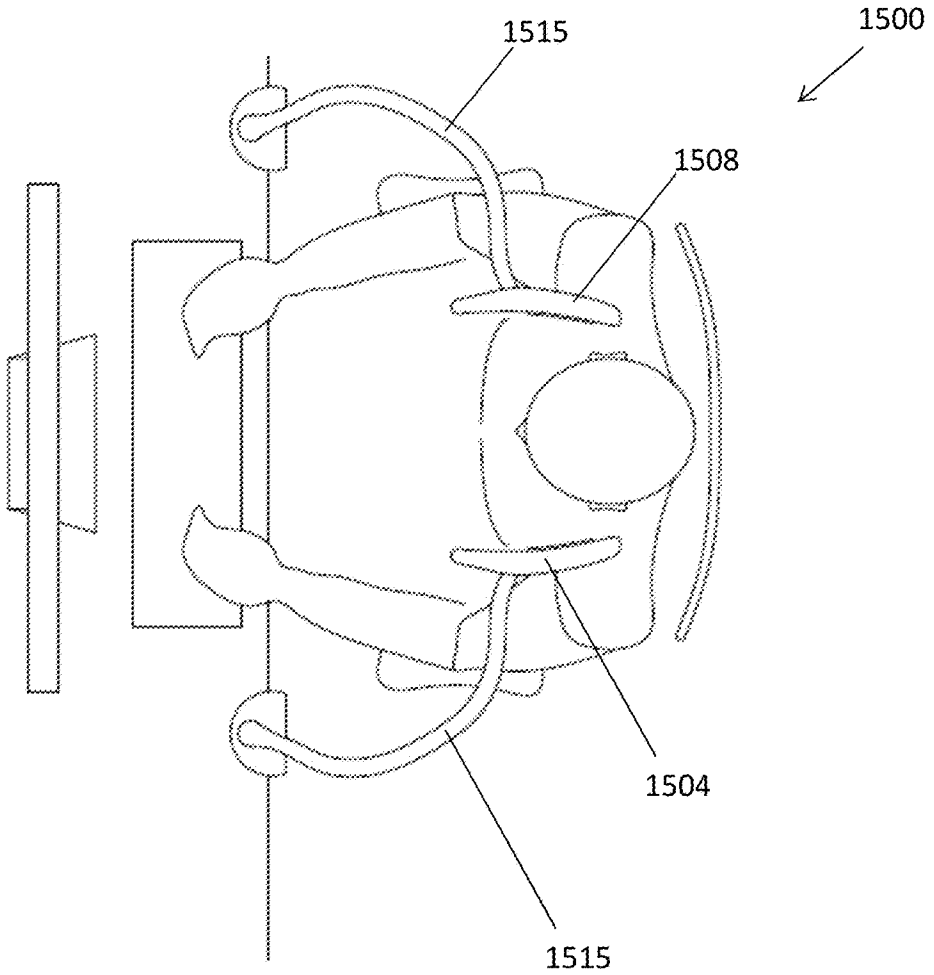
Figure 19:
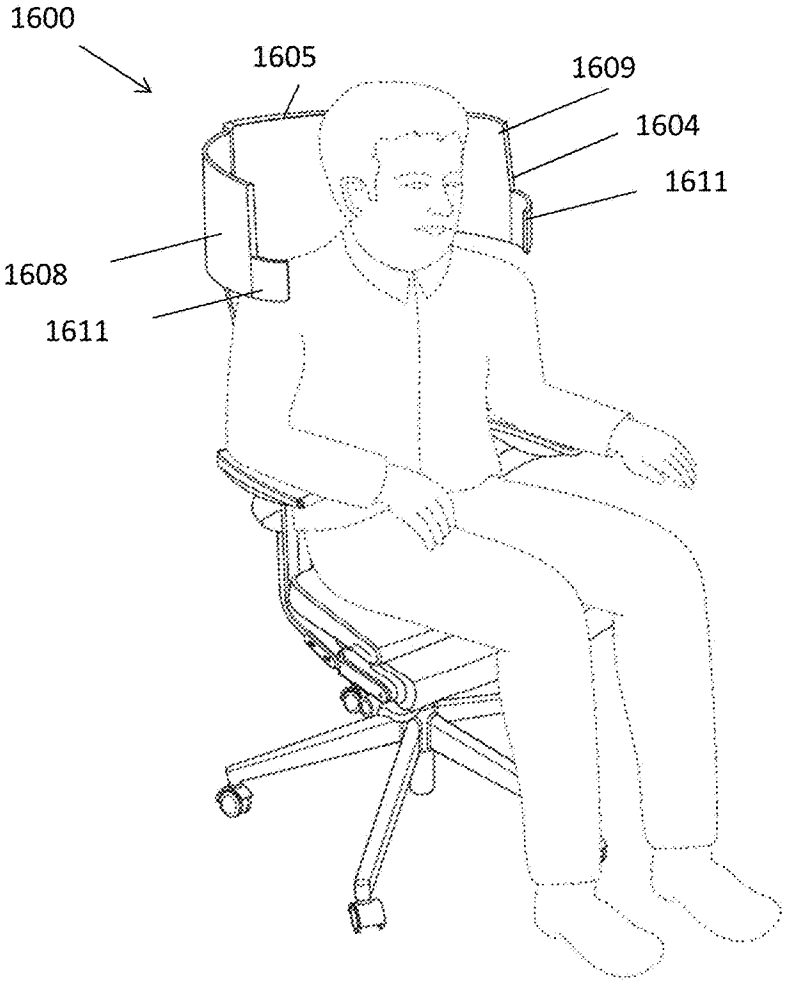
Figure 20:
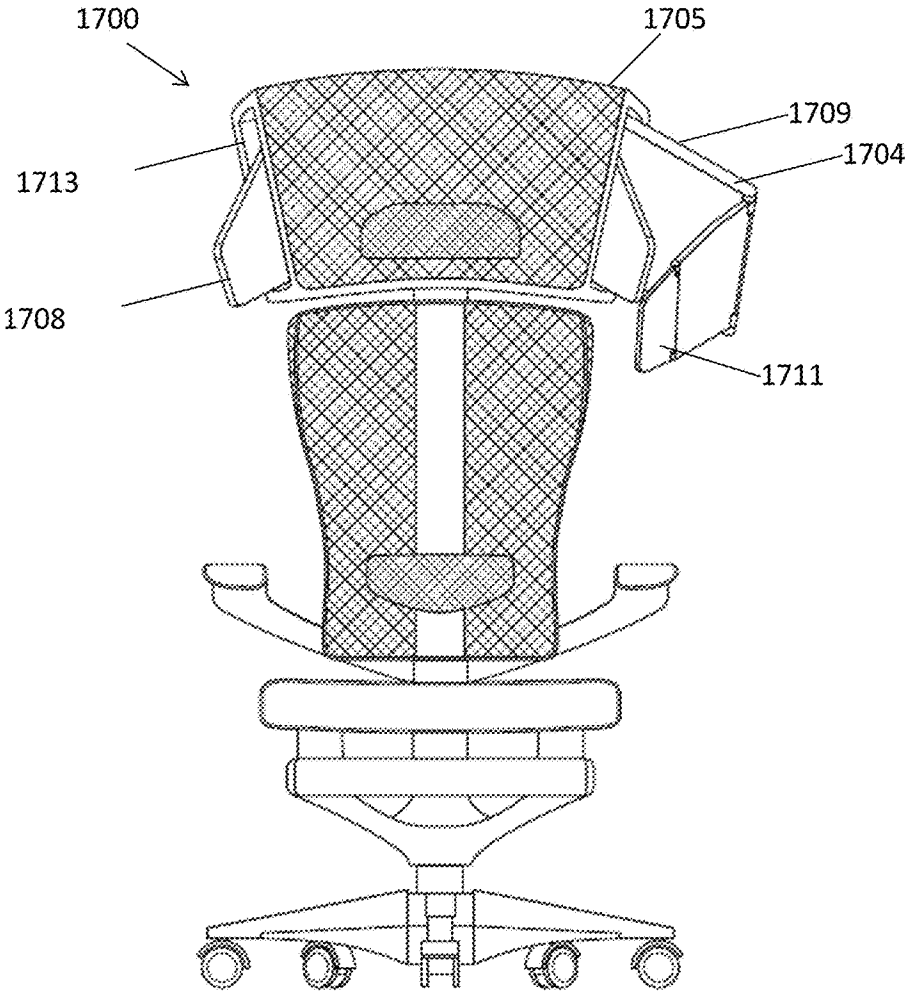
Figure 21:
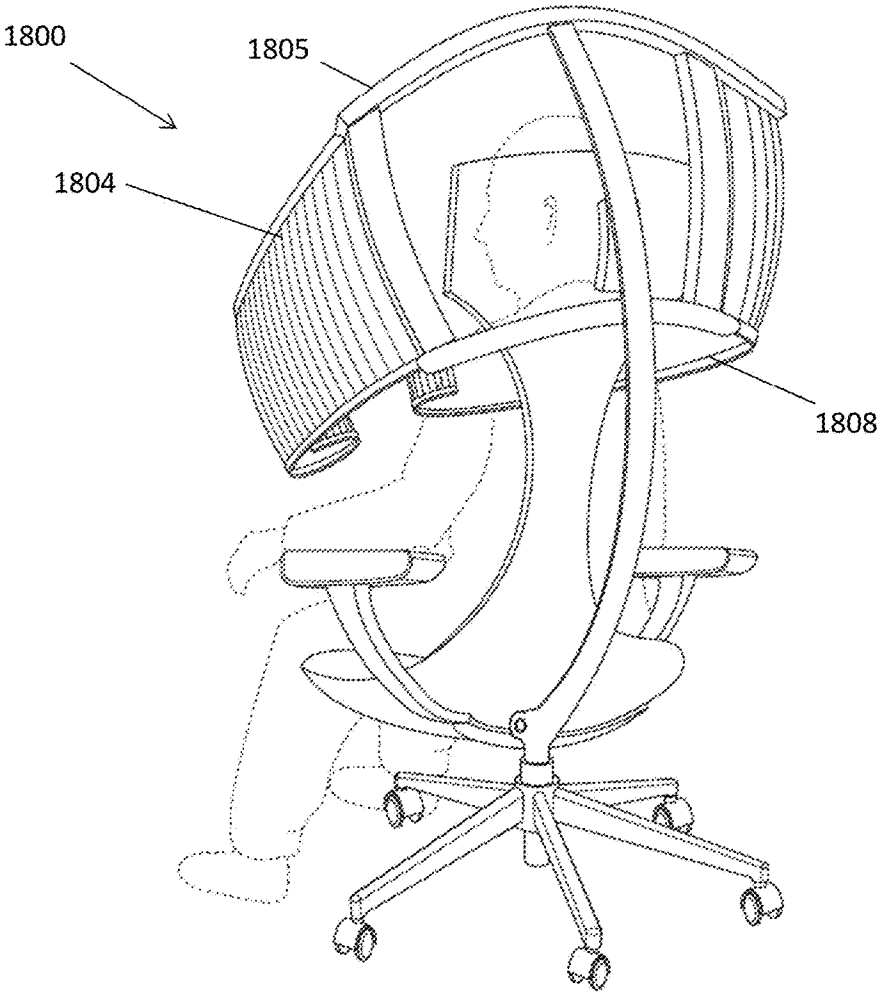
Figure 22:
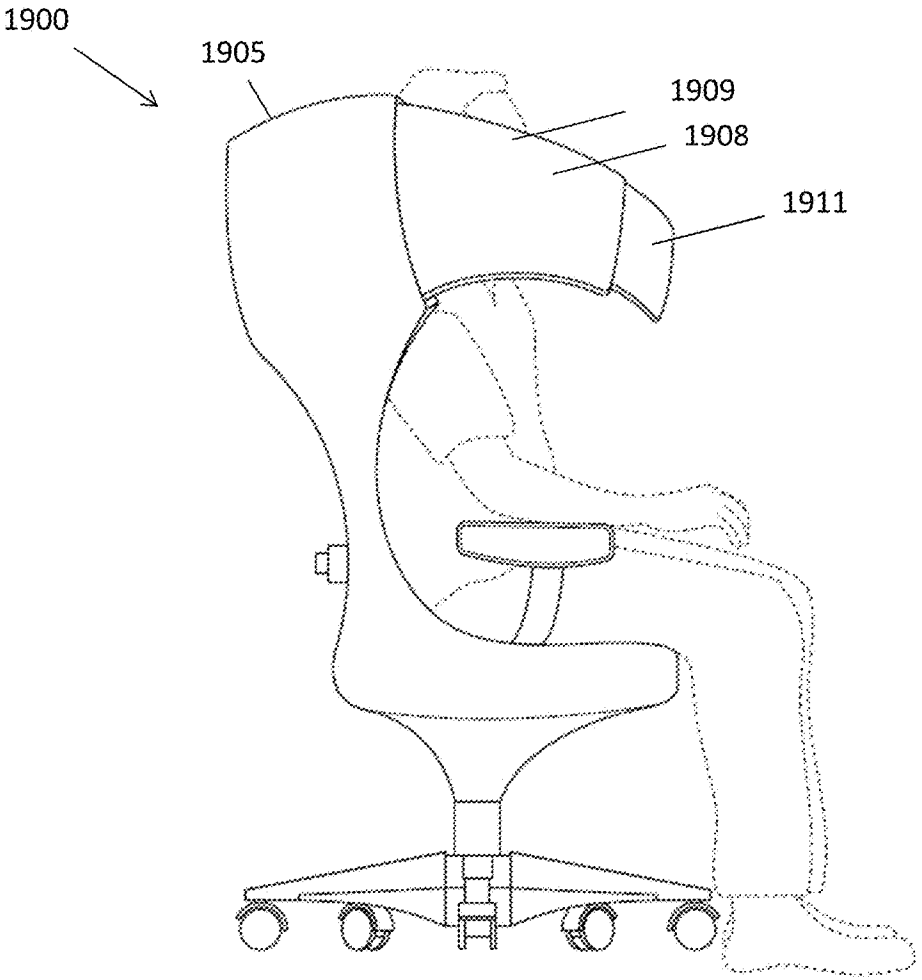
Figure 23:
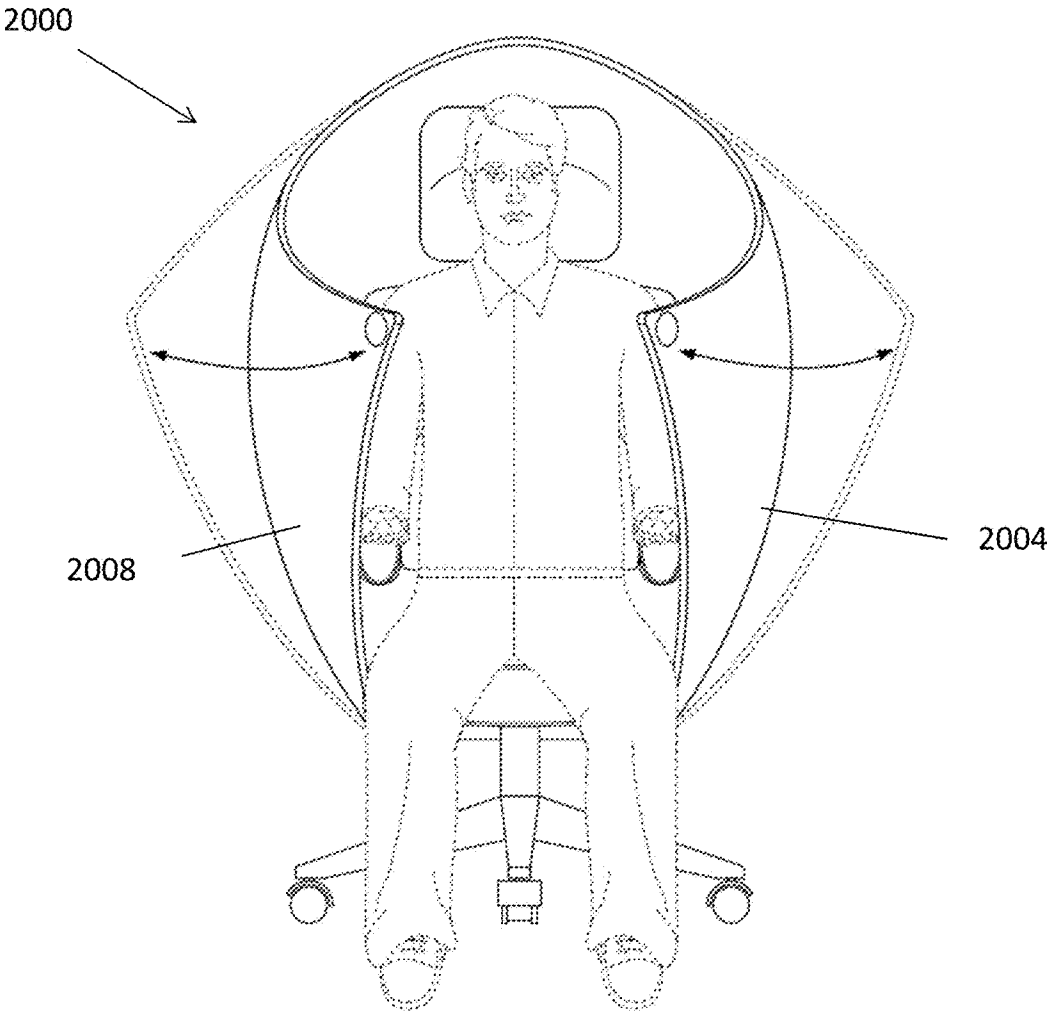
Figure 24:
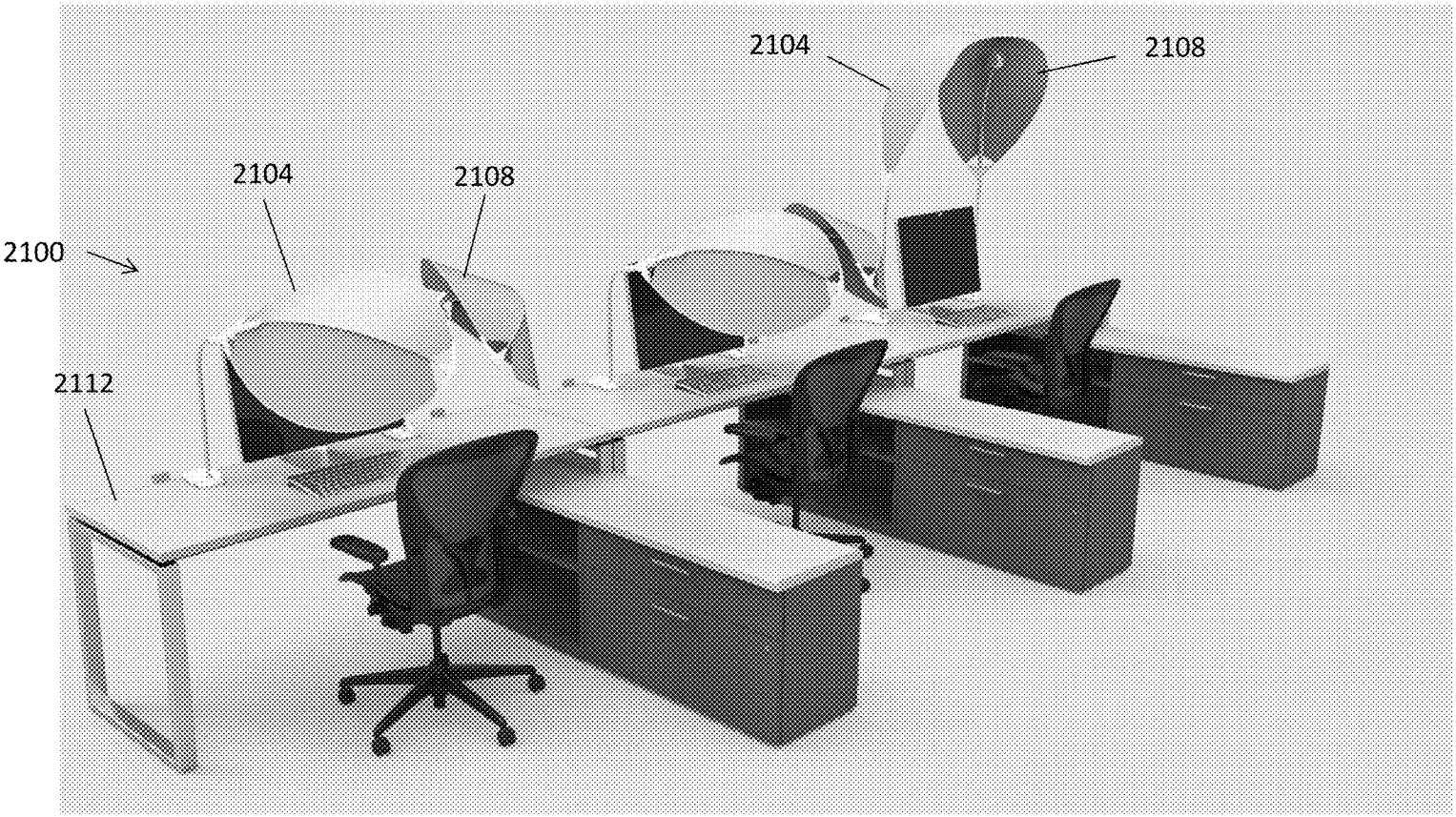
Figure 25:
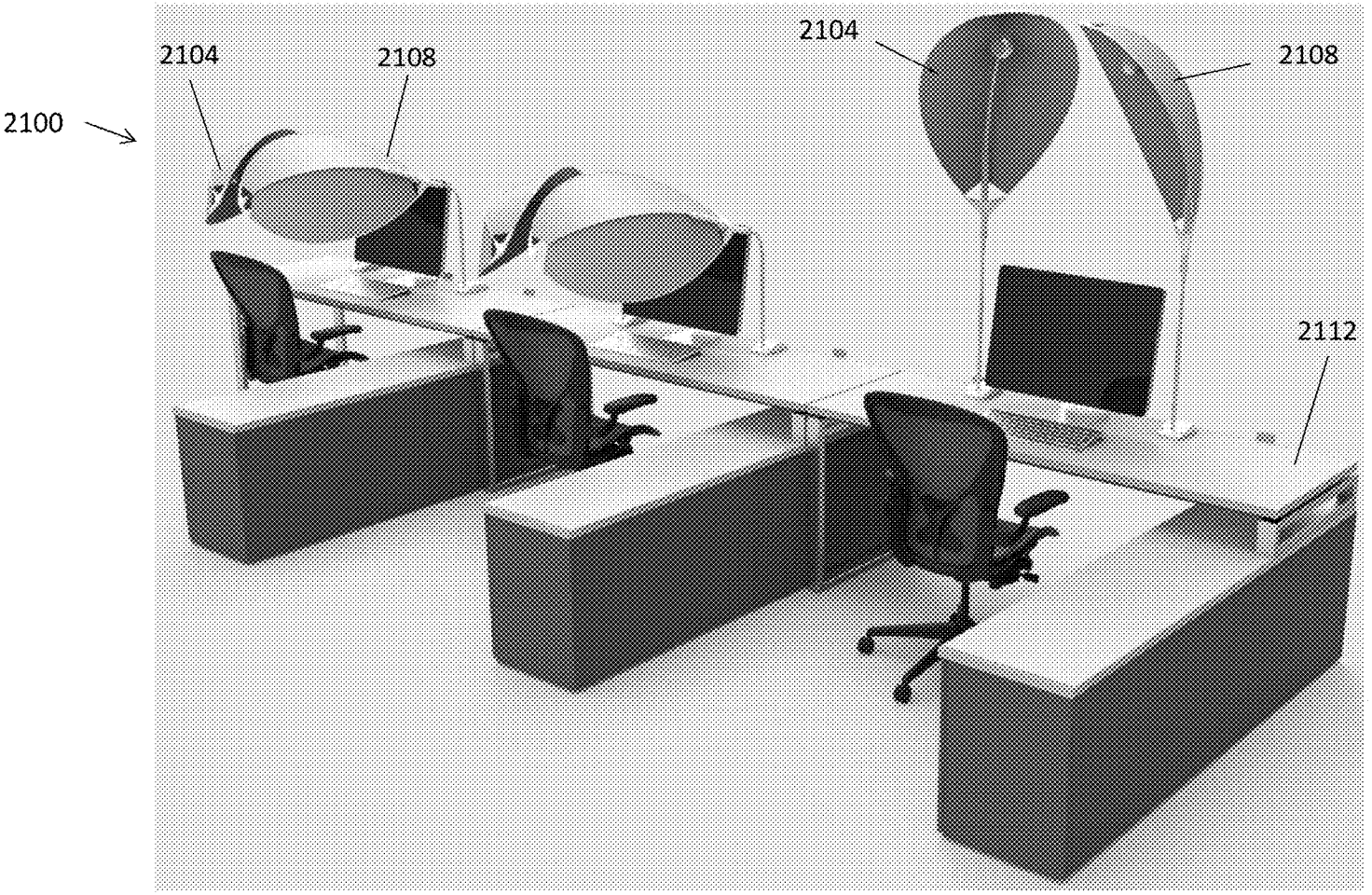
Figure 26:
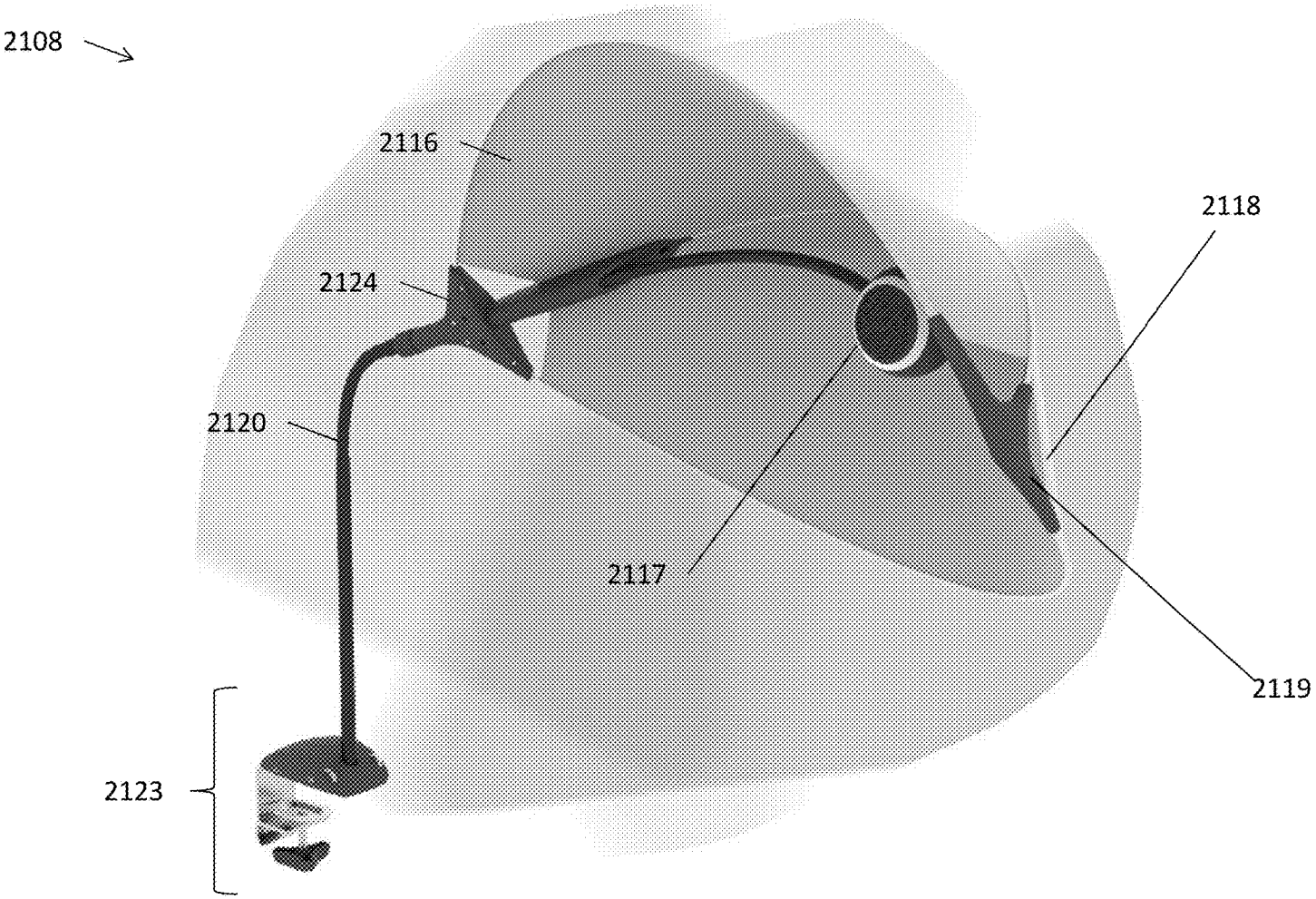
Figure 27:
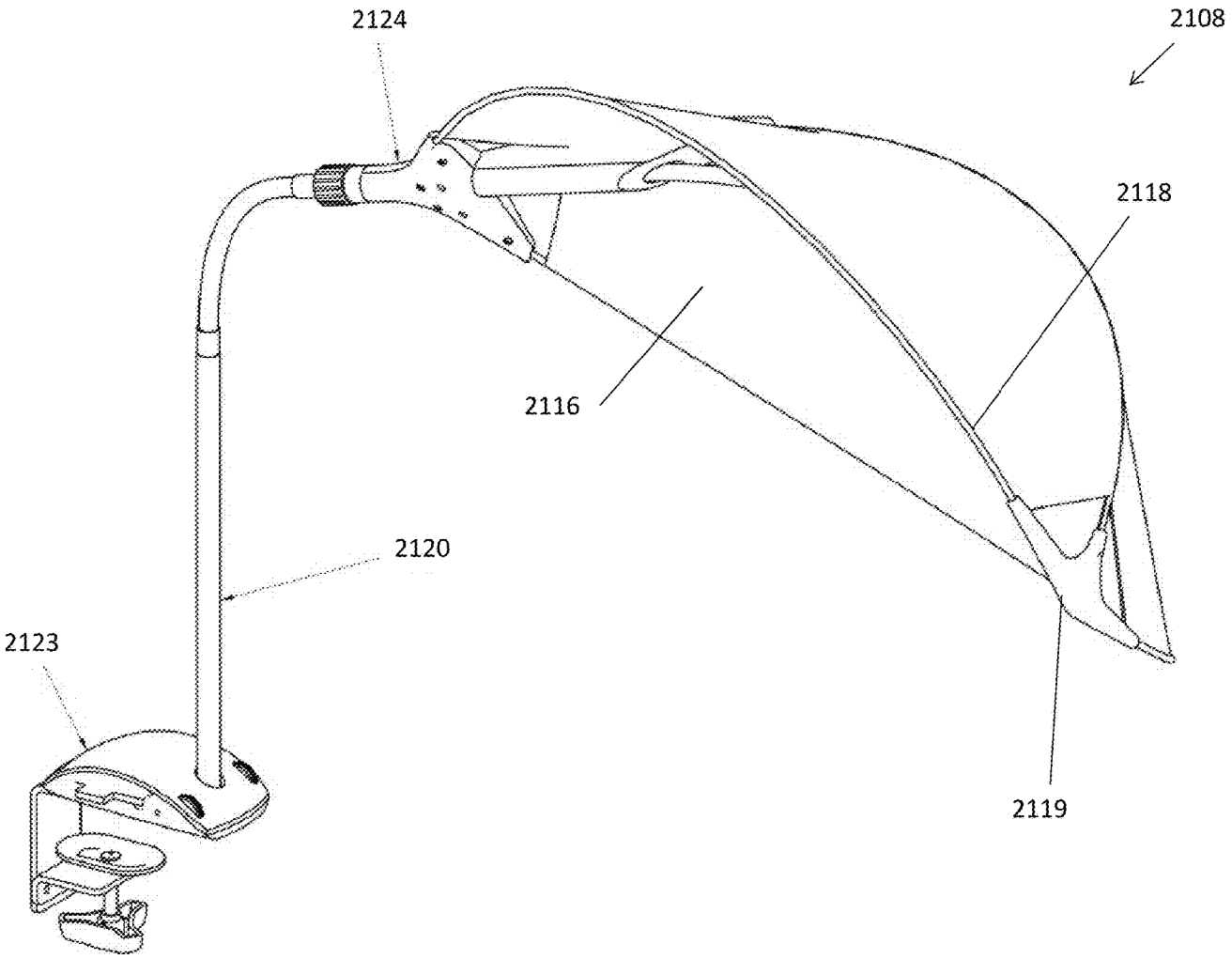
Figure 28:
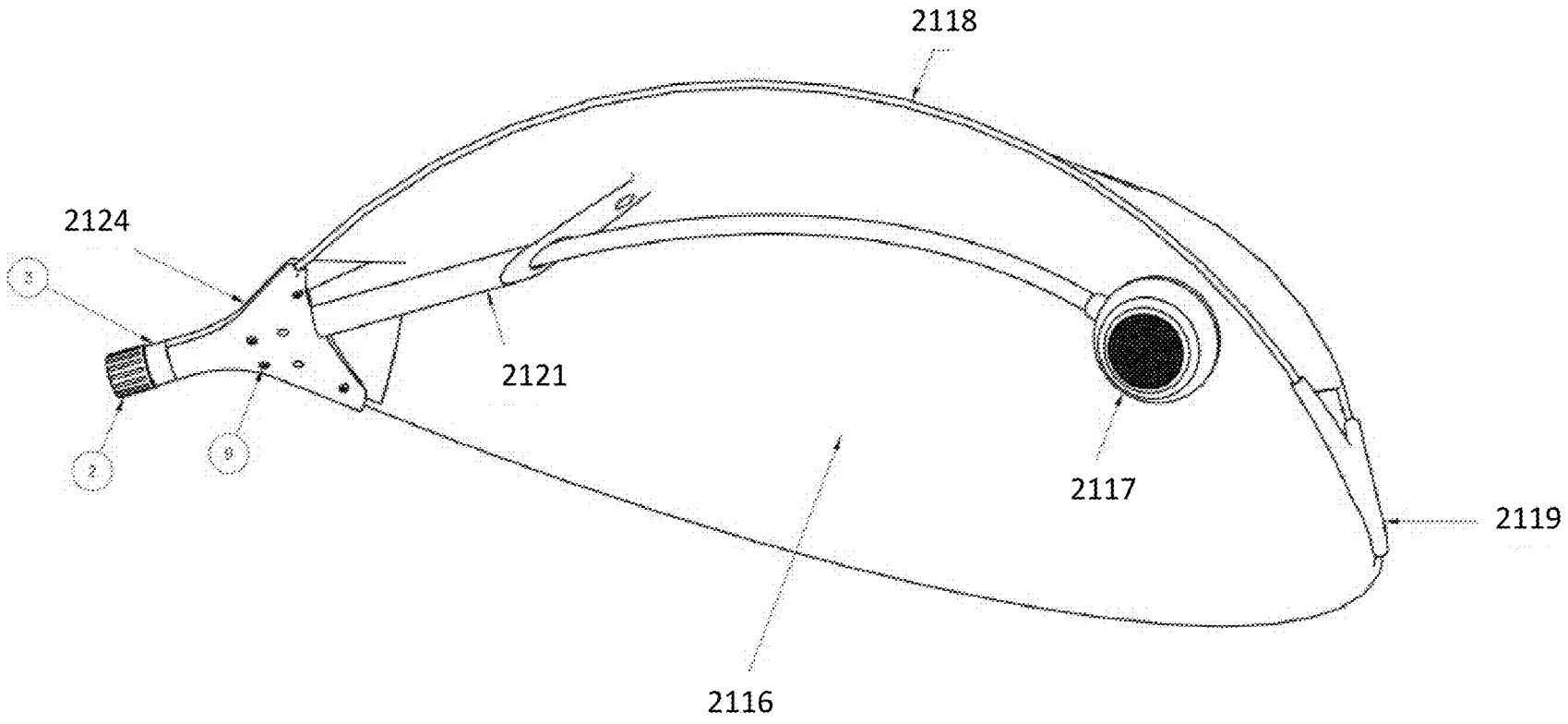
Figure 30:
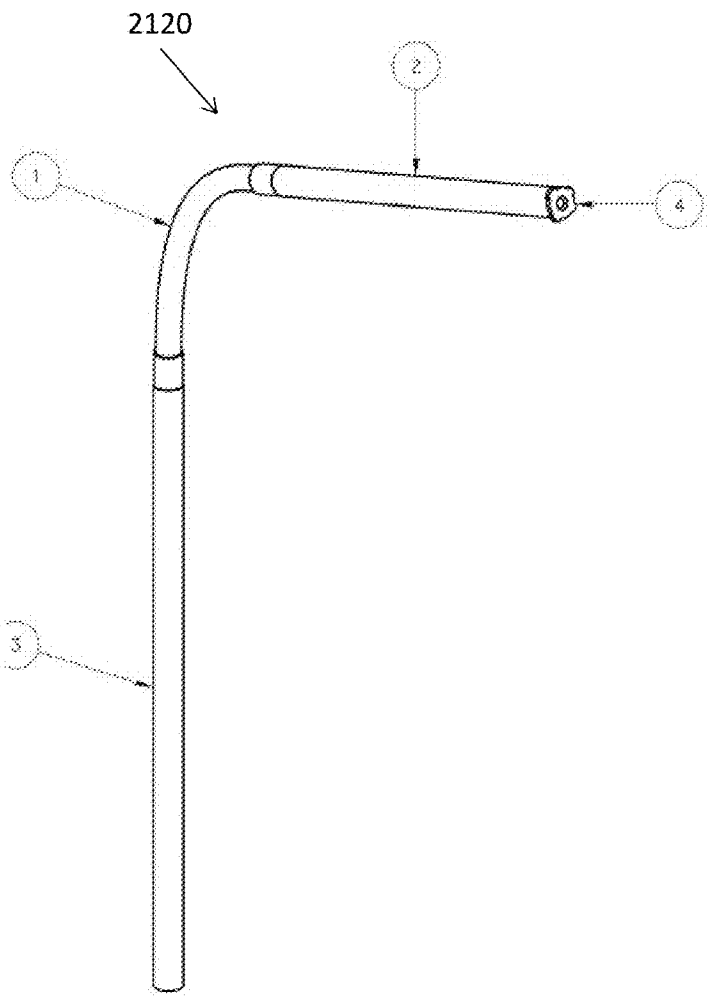
Figure 29:
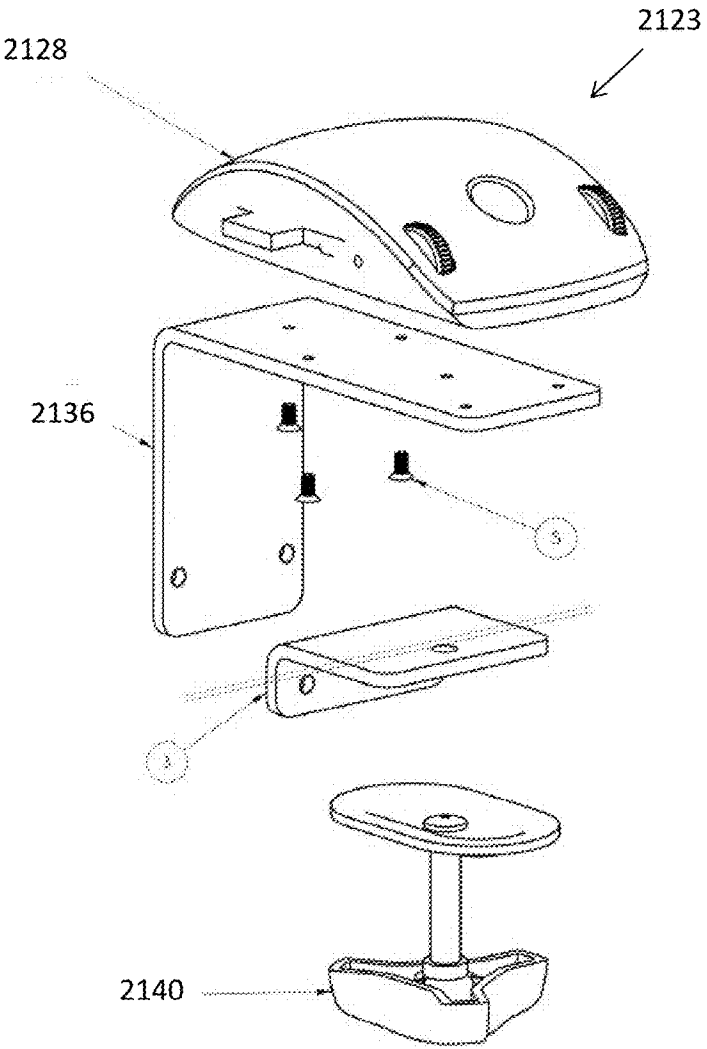
Figure 31:
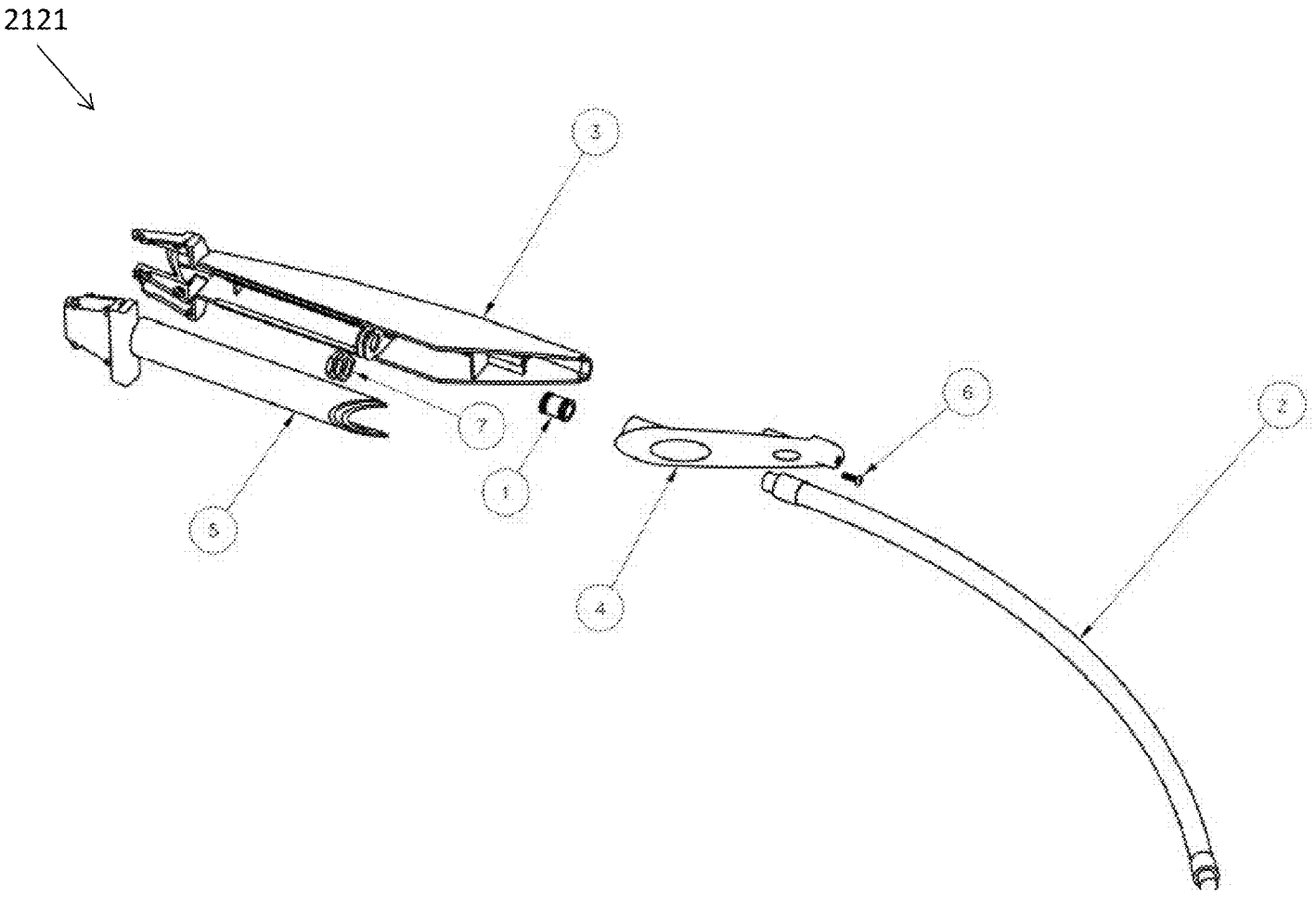
Figure 33:
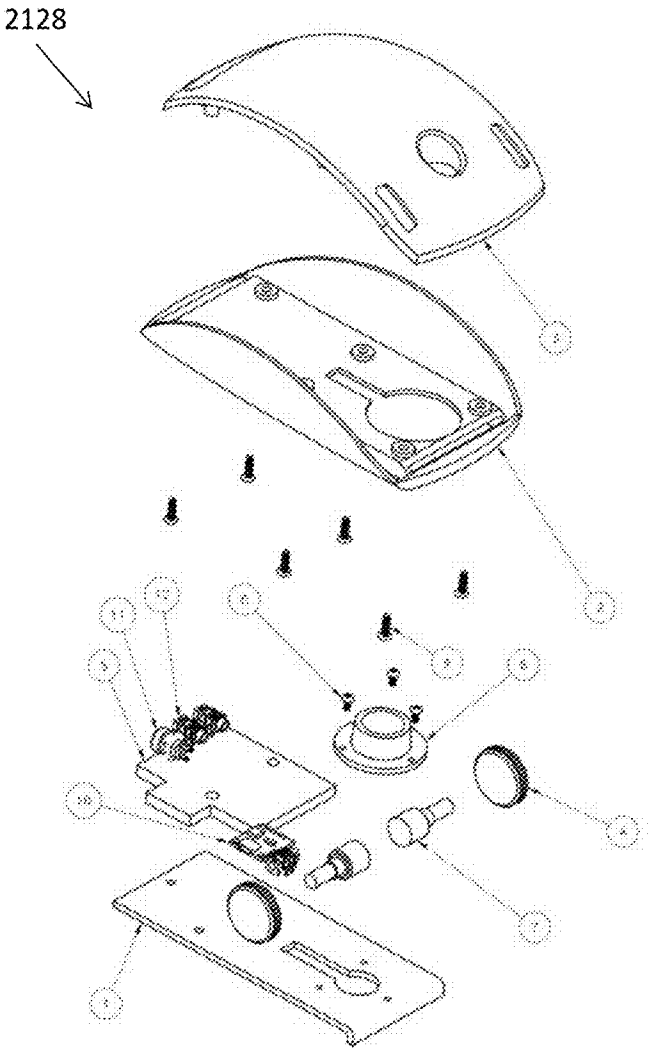
Figure 32:
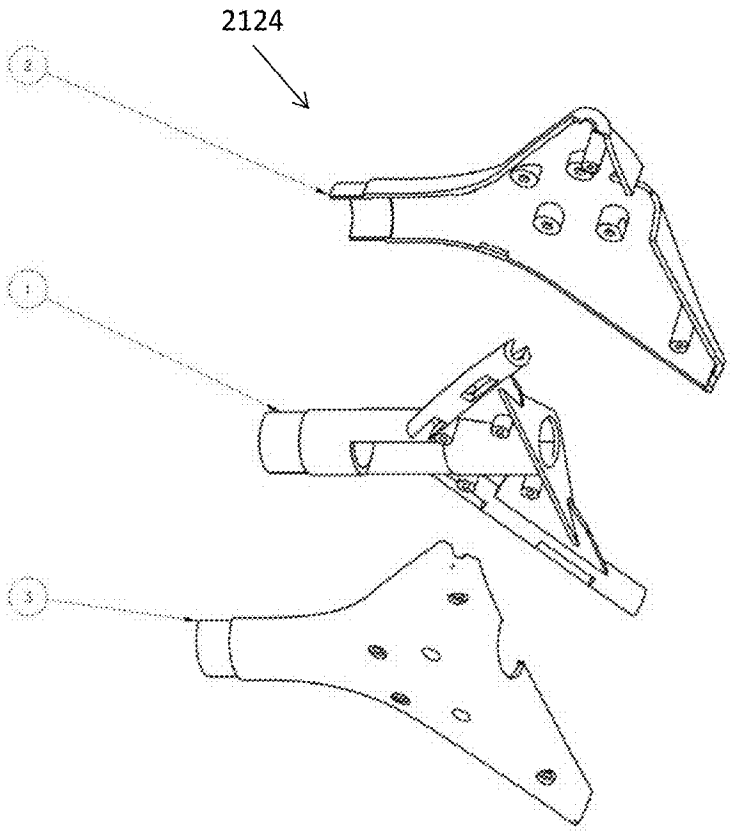
Figure 34:
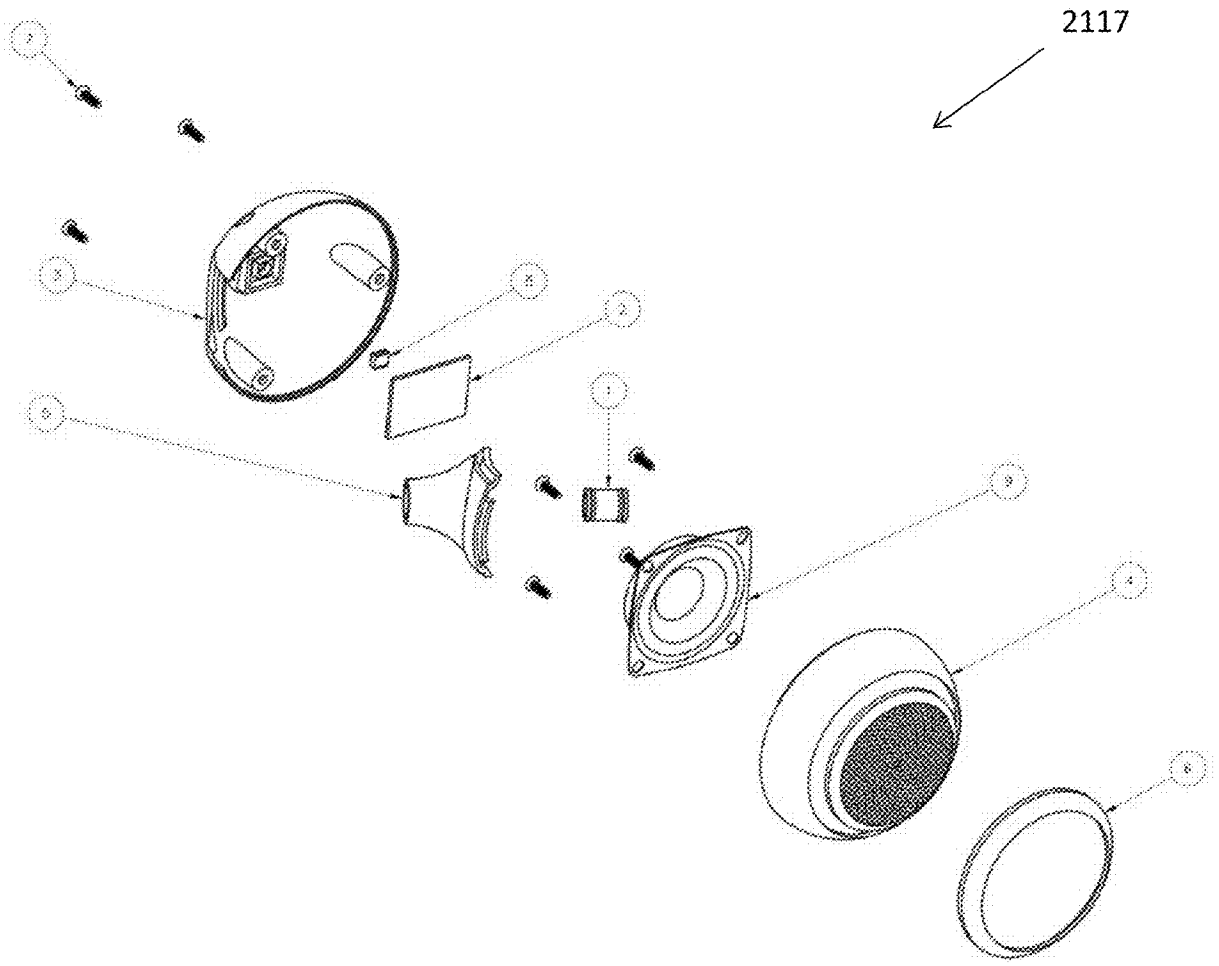
Figure 35:
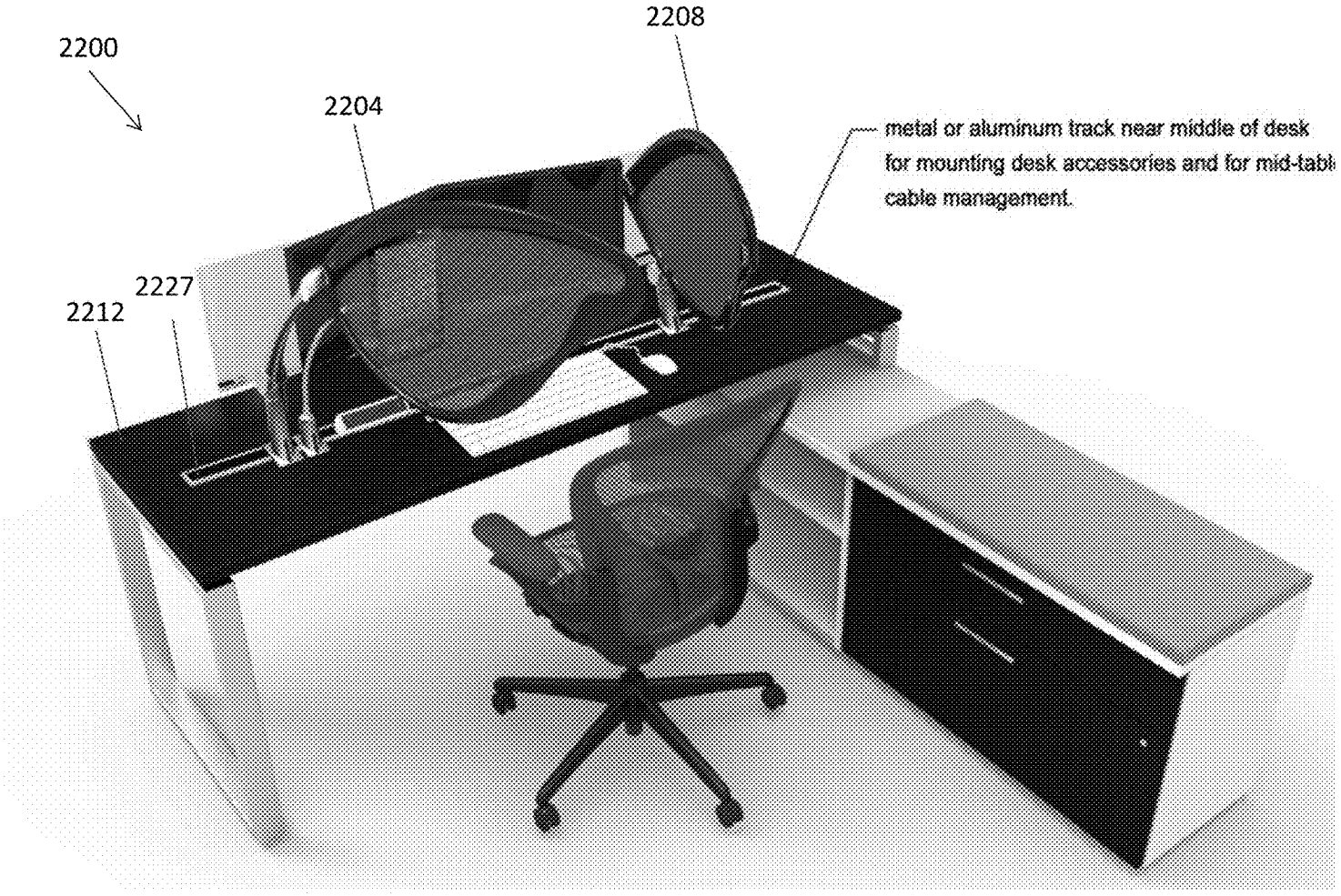

FIG. 17 includes side views of visual and/or acoustic privacy features according to an exemplary embodiment;

FIG. 18 is a top view showing visual and/or acoustic privacy features mounted to and/or supported by a desk according to an exemplary embodiment;

FIG. 19 is a perspective front view of a wheeled office chair having visual and/or acoustic privacy features according to an exemplary embodiment;

FIG. 20 is a front view of a wheeled office chair having visual and/or acoustic privacy features according to an exemplary embodiment;

FIG. 21 is a perspective back view of a wheeled office chair having visual and/or acoustic privacy features according to an exemplary embodiment;

FIG. 22 is a side view of a wheeled office chair having visual and/or acoustic privacy features according to an exemplary embodiment;

FIG. 23 is a front view of a wheeled office chair having visual and/or acoustic privacy features according to an exemplary embodiment;

FIGS. 24 and 25 are perspective views showing privacy features mounted to and/or supported by desks and in different configurations according to an exemplary embodiment;

FIGS. 26 and 27 are perspective views of one of the privacy features shown in FIGS. 24 and 25;

FIG. 28 is a perspective view of a portion of the privacy feature shown in FIGS. 26 and 27;

FIG. 29 is an exploded perspective view of the mounting mechanism of the privacy feature shown in FIGS. 26 and 27, wherein the mounting mechanism is usable for mounting the privacy feature to a support surface, such as desk, table, etc.;

FIG. 30 is a perspective view of the support member(s) or assembly (e.g., gooseneck, handle, extension, stem, support arm, etc.) of the privacy feature shown in FIGS. 26 and 27;

FIG. 31 is a perspective view of the spine mount assembly of the privacy feature shown in FIGS. 26 and 27, wherein the spine mount assembly is used for coupling the element and speaker to the support member(s) or assembly shown in FIG. 30;

FIG. 32 is an exploded perspective view of components that are usable for coupling the spine mount assembly shown in FIG. 31 and support member assembly shown in FIG. 30 as shown in FIG. 27;

FIG. 33 is an exploded perspective view of the base of the mounting mechanism shown in FIG. 29, and also illustrating various components (e.g., wheels, buttons, switches, printed circuit board; stereo jack, inputs, etc.) for controlling operation of the speaker;

FIG. 34 is an exploded perspective view of the speaker assembly of the privacy feature shown in FIGS. 26 and 27, and illustrating the portions of the housing, board, light emitting diode (LED), coupler, speaker, and speaker ring of the speaker assembly; and FIG. 35 is a perspective view of showing privacy features slot mounted within a slot or track along (e.g., at about a middle of, towards the front of, about 8 to 12 inches behind the frontmost edge of the desk, etc.) a work surface of a desk according to an exemplary embodiment.

DETAILED DESCRIPTION

Example embodiments will now be described more fully with reference to the accompanying drawings.

The inventor hereof has recognized that it would be beneficial to allow coworkers in an open office environment to collaborate and work together, while also allowing them to speak on a telephone as though in a private office without the surrounding noise of fellow coworkers in the open office environment. For example, coworkers in an open office environment need to be able to communicate with each other, while also being able to talk on the phone without the person on the other end of the line hearing the chatter in the background. The individual also needs to be able to concentrate while adjacent coworkers are on the phone. Similar to the open office environment, it can also be difficult to have visual and/or acoustic privacy in other open environments, such as in schools, restaurants, cafeterias, airport terminals, testing centers, libraries, home offices, etc.

Accordingly, the inventor has developed and discloses herein exemplary embodiments of apparatus or devices including visual and/or acoustic privacy features that can provide a user with at least some privacy and isolation from others in the open environment. For example, exemplary embodiments are disclosed that include visual and/or acoustic privacy features for furniture (e.g., office chair, desk, table, cubicle, etc.). For example, the visual and/or acoustic privacy features (e.g., pads, screens, pads, blinders, panels, walls, wings, flaps, non-electronic elements, other means for providing visual and/or acoustic privacy features, etc.) may be releasably attachable or mountable to, fixedly attached to, integral to, supported by, etc. a support surface of a piece of furniture, floor, ceiling, canopy, etc. Or, for example, the visual and/or acoustic privacy features may be a free standing device, e.g., free standing device on a support surface (e.g., desktop, floor, etc.) without being mounted or attached to the support surface.

The visual and/or acoustic privacy features may be movable relative to the user and/or furniture between at least a first configuration and a second configuration. In the first configuration, the visual and/or acoustic privacy features are not being used to provide visual or acoustic privacy (e.g., not disposed adjacent, along, or around the user's head, etc.) such that they do not inhibit the user from interacting with others. For example, the visual and/or acoustic privacy features may be stowed and/or out of the way such that they are spaced apart from (e.g., not generally over, adjacent, or in front of, etc.) the user's ears, eyes, and/or mouth, etc. But in the second configuration, the visual and/or acoustic privacy features are deployed for use (e.g., disposed generally over, adjacent, and/or in front of the user's ears, eyes, and/or mouth, etc.) so as to provide the user with at least some visual and/or acoustic privacy and isolation from others, such as by acoustically dampening of incoming and/or outgoing sound and/or by providing visual blinders. Accordingly, the first configuration may also be referred to as a stowed, non-use, non-operational, or interaction configuration, while the second configuration may also be referred to as a deployed, in-use, operational, or privacy configuration.

In some embodiments, the visual and/or acoustic privacy features may be movable relative to the user and/or furniture into a third configuration. For example, the visual and/or acoustic privacy features may be moved into a third configuration in which they may be positioned generally upright and above a computer monitor to thereby offer a hood effect to help control light (e.g., block or shield incoming light, etc.). The position of the visual and/or acoustic privacy features may provide visual cues to co-workers. For example, the visual and/or acoustic privacy features may be positioned in a certain configuration (e.g., above the user's head, etc.) to indicate that the user is open for conversation. As another example, the visual and/or acoustic privacy features may be positioned adjacent or around the user's head to indicate that the user is tasking and does not wish to be disturbed.

Figure 1:
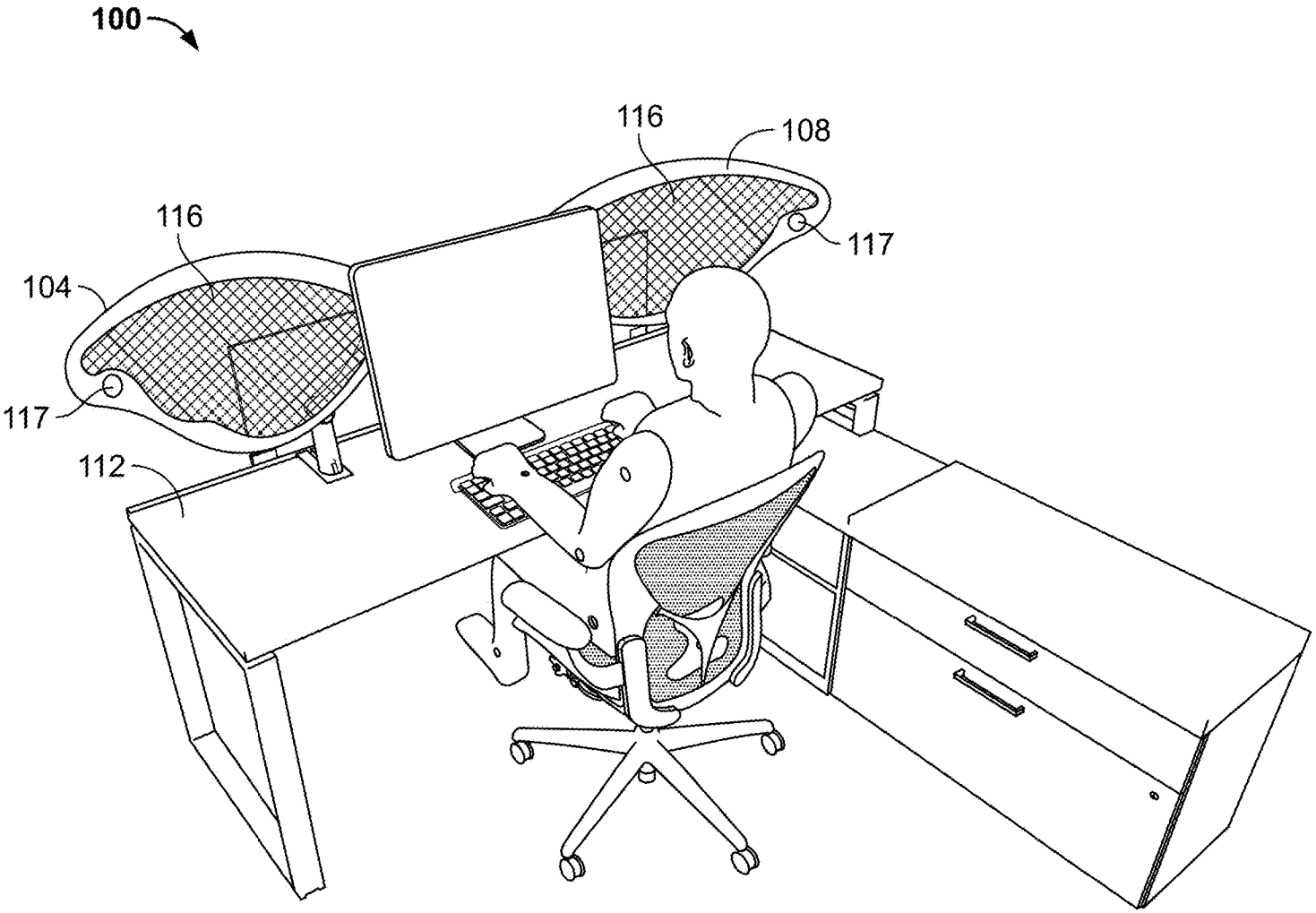
Figure 2:
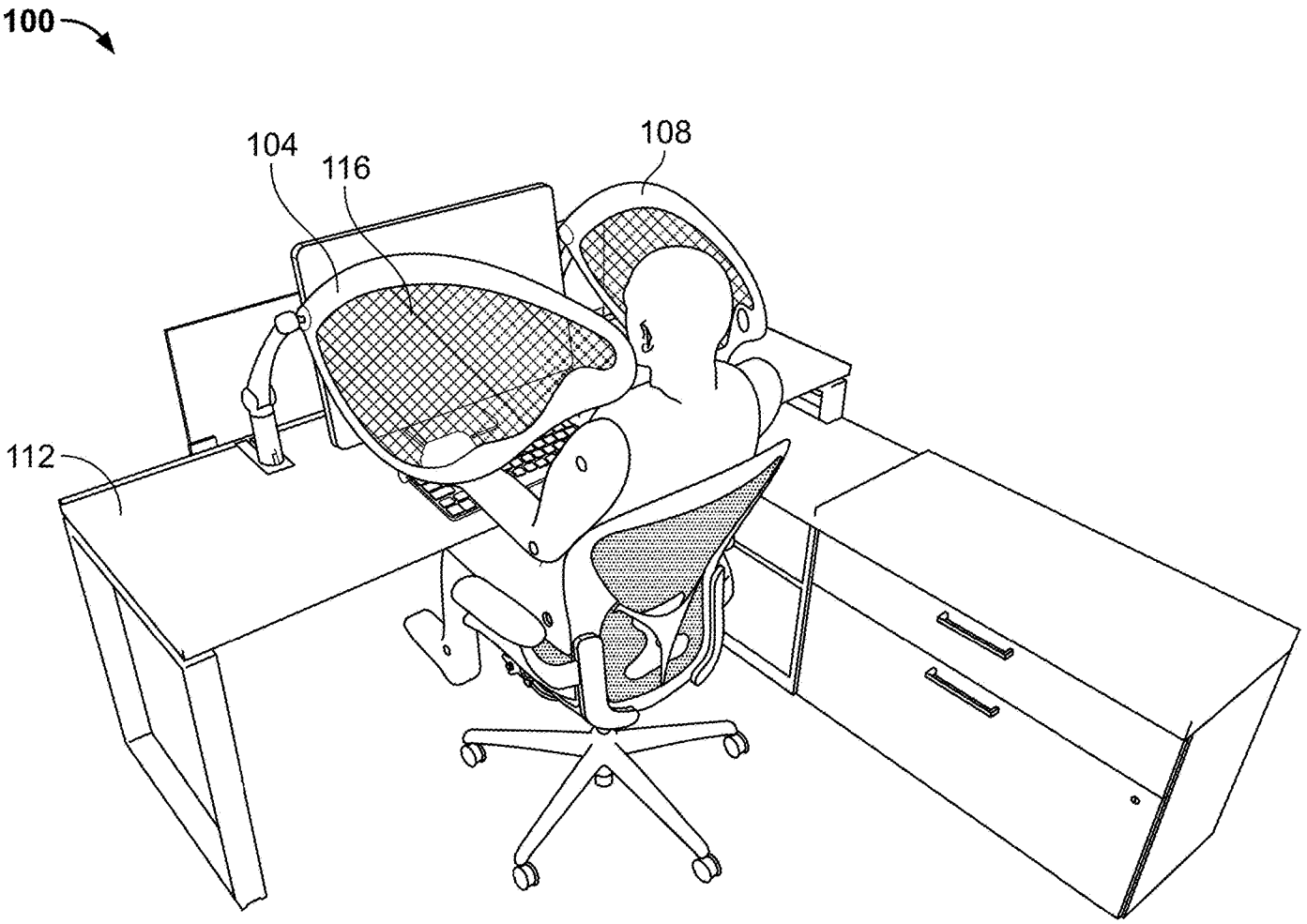
Figure 3:
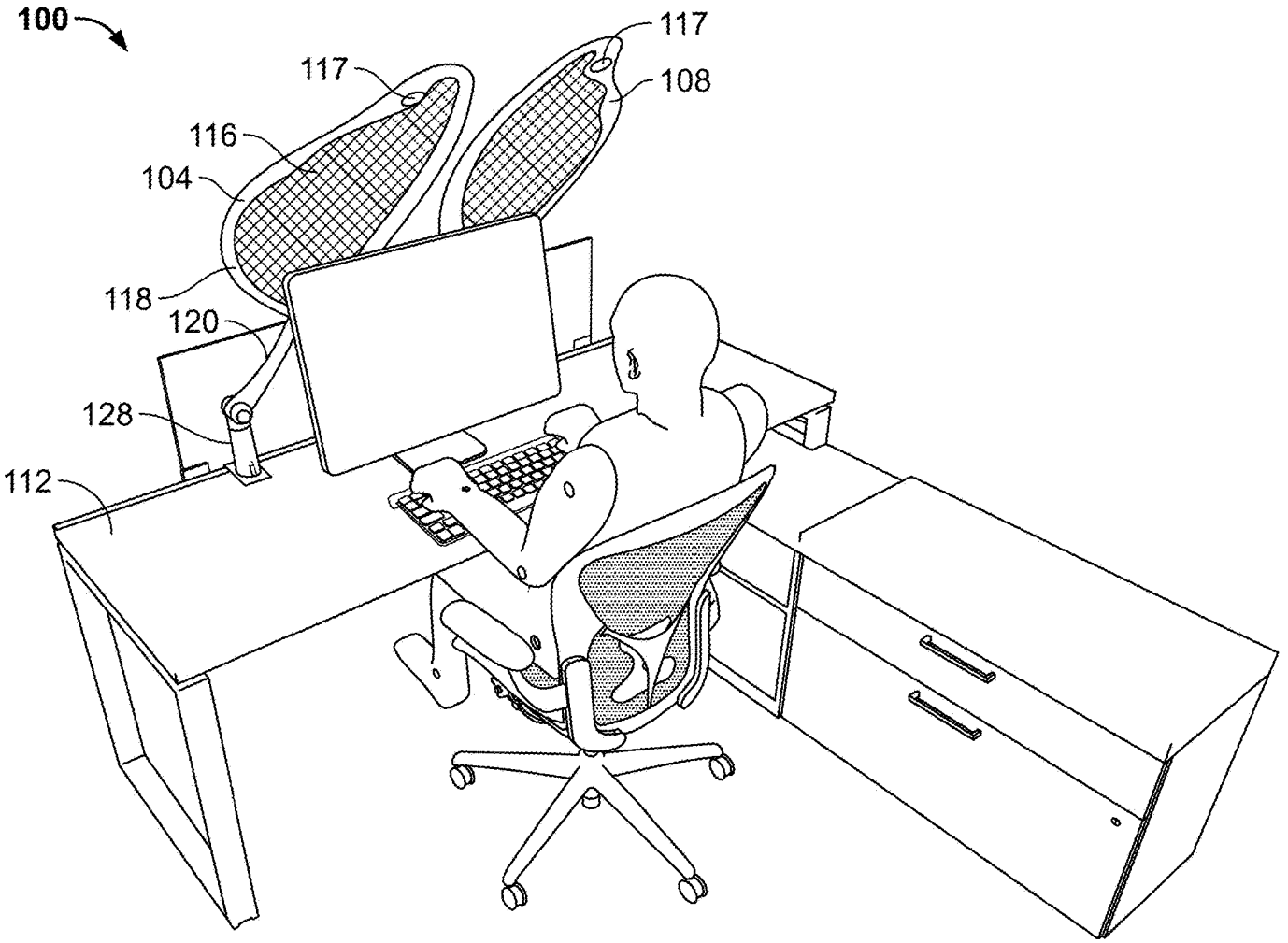

With reference now to the figures, FIGS. 1 through 11 illustrate an exemplary embodiment 100 including first and second (or left and right) visual and/or acoustic privacy features 104, 108 embodying one or more aspects of the present disclosure. As shown in FIGS. 1 through 3, the visual and/or acoustic privacy features 104, 108 are mounted to and/or supported by a desk 112 in this example. Alternatively, the visual and/or acoustic privacy features 104, 108 may be mounted to and/or supported by other support surfaces, e.g., chairs, tabletops, etc.

In this example embodiment, the visual and/or acoustic privacy features 104, 108 are usable and reconfigurable between a plurality of configurations, including a first configuration (FIG. 1), a second configuration (FIGS. 2, 4A, and 4B), and a third configuration (FIG. 3). In the first configuration shown in FIG. 1, the visual and/or acoustic privacy features 104, 108 are not disposed adjacent the user's ears or along opposite side of the user's head, such that the user may easily and readily interact with others. Also in the first configuration, the visual and/or acoustic privacy features 104, 108 may provide the user with visual privacy by creating a wall or blinder in front of the desk, which, in turn, may help the user to better concentrate and not be distracted by on goings in front of the desk.

Figure 4A:
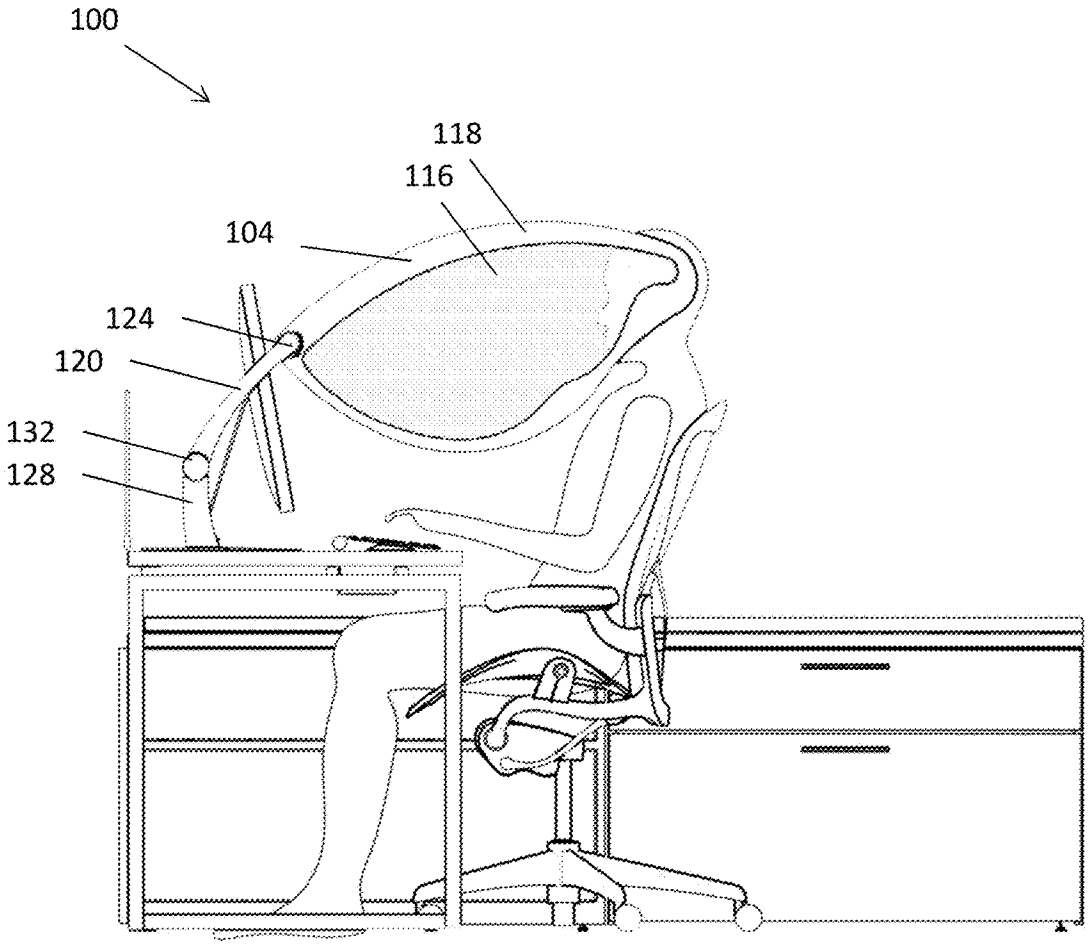
FIG. 4A is a side view of the visual and/or acoustic privacy features of FIG. 2 shown in the second configuration in which the visual and/or acoustic privacy features are adjacent the user's ears and along opposite sides of the user's head so as to provide the user with at least some visual and/or acoustic privacy and isolation from others according to an exemplary embodiment.
Figure 4B:
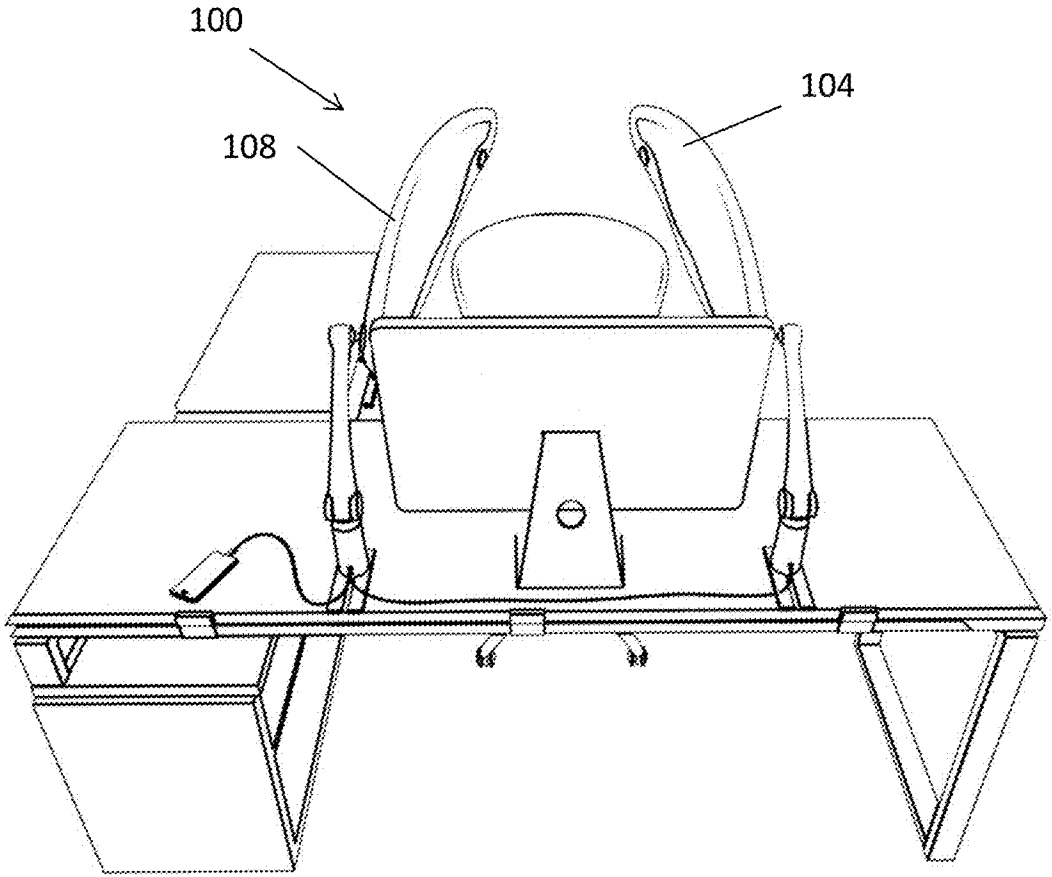
FIG. 4B is a front perspective view of the visual and/or acoustic privacy features of FIG. 2 shown in the second configuration in which the visual and/or acoustic privacy features would be adjacent the user's ears and along opposite sides of the user's head so as to provide the user with at least some visual and/or acoustic privacy and isolation from others according to an exemplary embodiment.

In the second configuration shown in FIGS. 2, 4A, and 4B, the visual and/or acoustic privacy features 104, 108 are deployed for use (e.g., disposed generally over, adjacent, and/or in front of the user's ears, eyes, and/or mouth, etc.) so as to provide the user with at least some visual and/or acoustic privacy and isolation from others. As shown in FIG. 4A, the visual and/or acoustic privacy features 104, 108 are disposed generally around the user's head so as to cover the user's ears and eyes from the side. In the second configuration shown in FIG. 4A, the visual and/or acoustic privacy features 104, 108 acoustically dampen incoming and/or outgoing sound and provide visual blinders. Accordingly, the features 104, 108 may thus provide means for acoustically dampening incoming and/or outgoing sound and providing visual blinders.

In the third configuration shown in FIG. 3, the visual and/or acoustic privacy features 104, 108 are positioned vertically upright so as to be at least partially above the user's eyes and computer monitor. The visual and/or acoustic privacy features 104, 108 may thus offer a hood effect to help control light when in the third configuration.

Additionally, or alternatively, any one of various configurations of the visual and/or acoustic privacy features 104, 108 may be used to provide visual cues to co-workers. For example, the visual and/or acoustic privacy features 104, 108 may be positioned in a certain configuration (e.g., above the user's head (FIG. 3), etc.) to visually indicate that the user is open for conversation. As another example, the visual and/or acoustic privacy features 104, 108 in the second configuration (FIG. 4A) may visually indicate that the user is tasking and does not wish to be disturbed.

Figure 6:
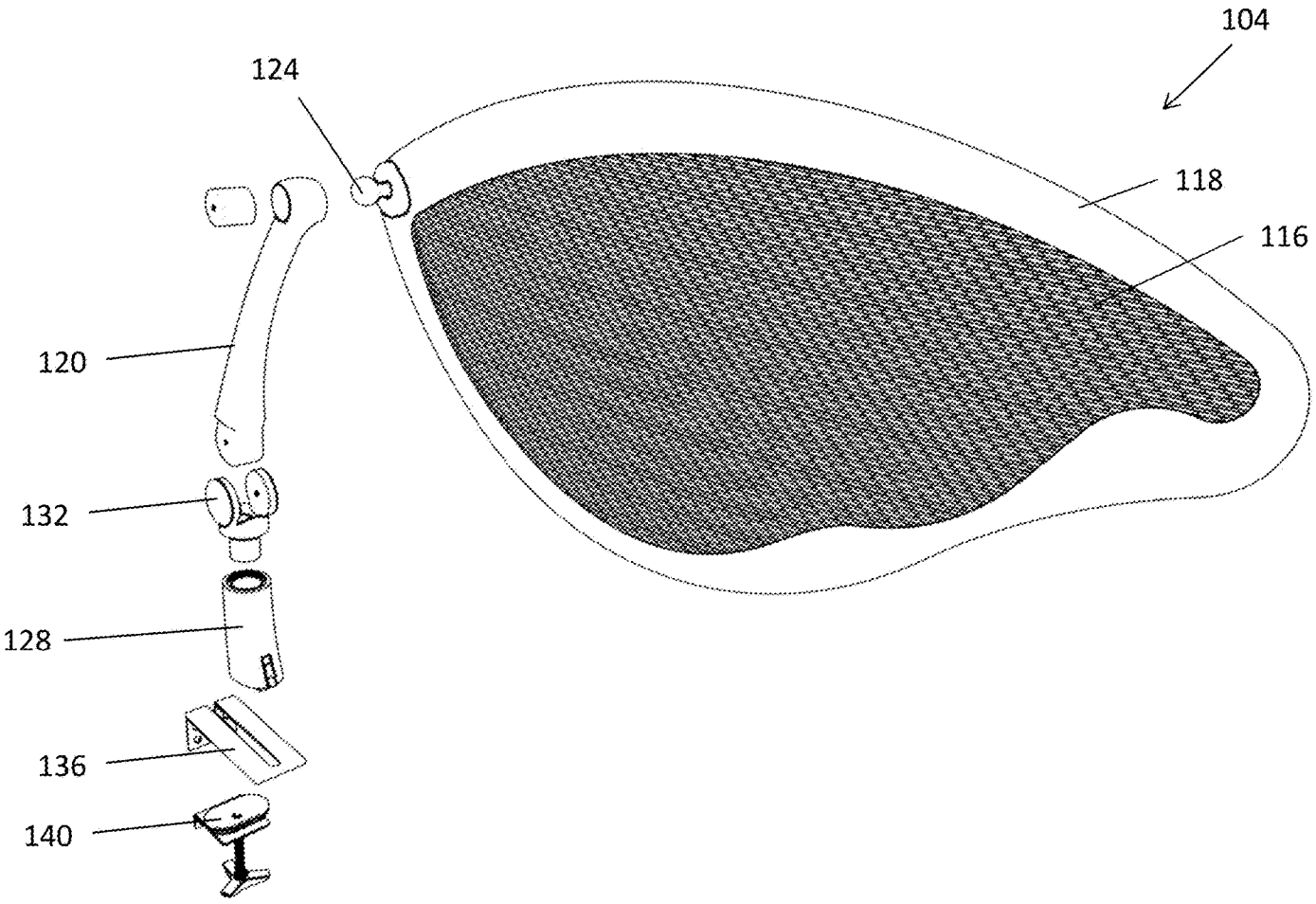
FIG. 6 is an exploded perspective view of one of the visual and/or acoustic privacy features shown in FIGS. 1 through 5.
Figure 7:
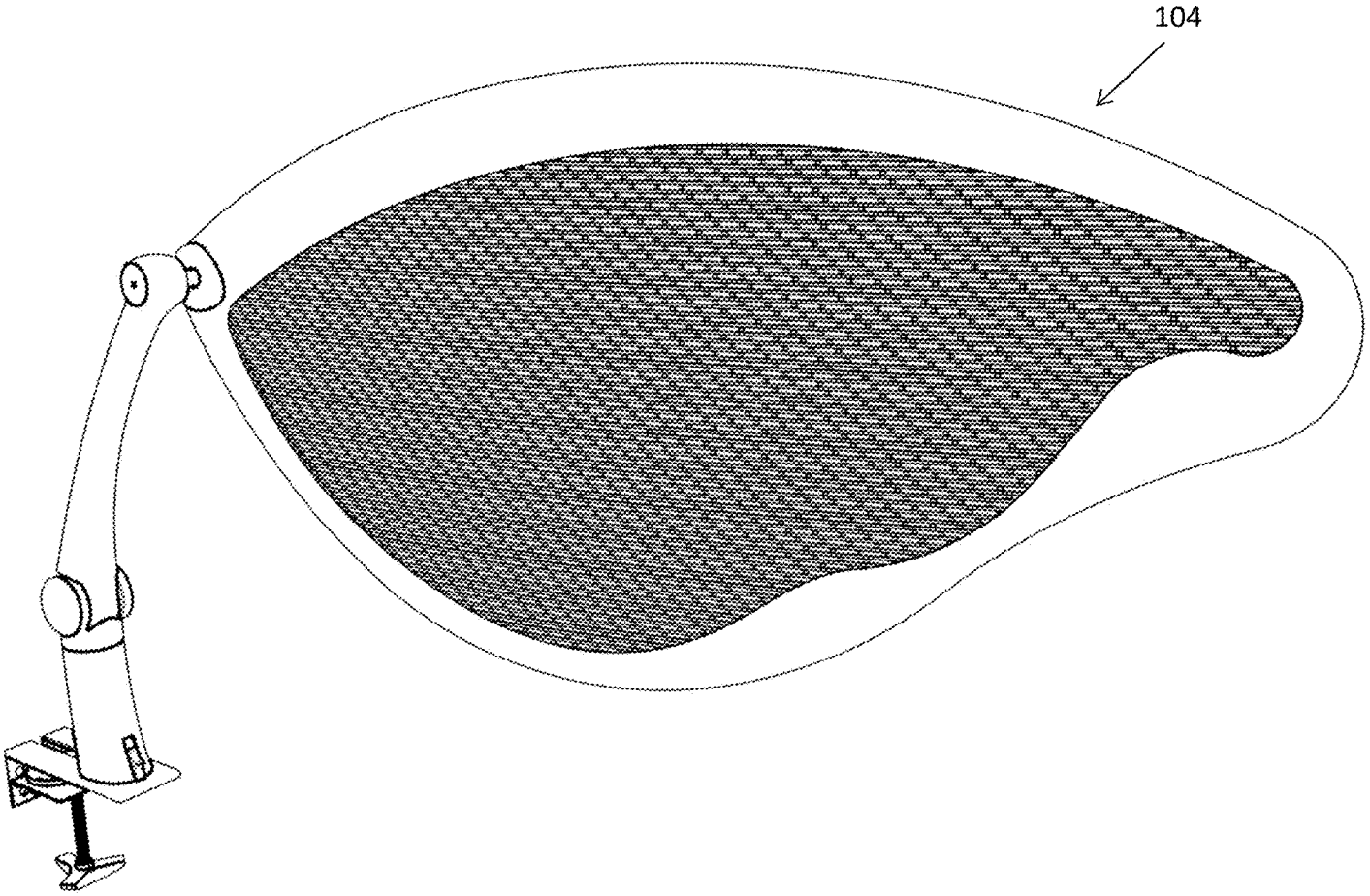
FIGS. 7 and 8 are perspective views of the visual and/or acoustic privacy feature shown in FIG. 6 after the components have been assembled together.
Figure 8:
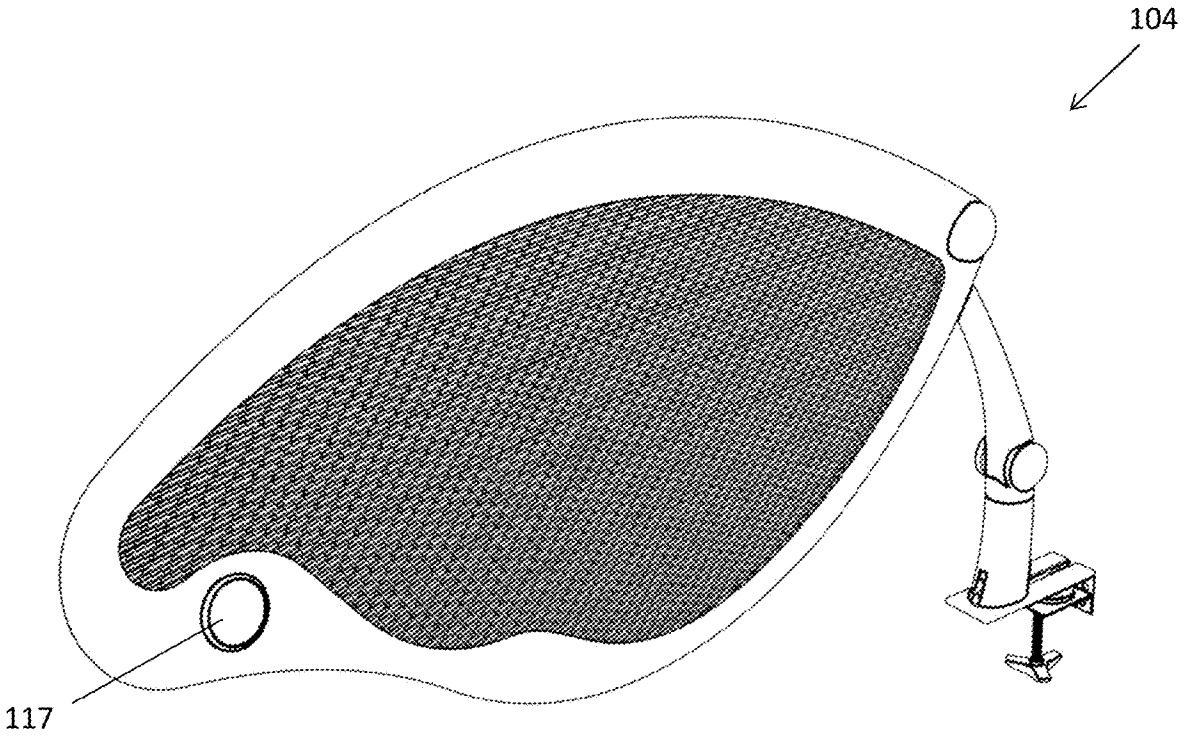
Figure 9:
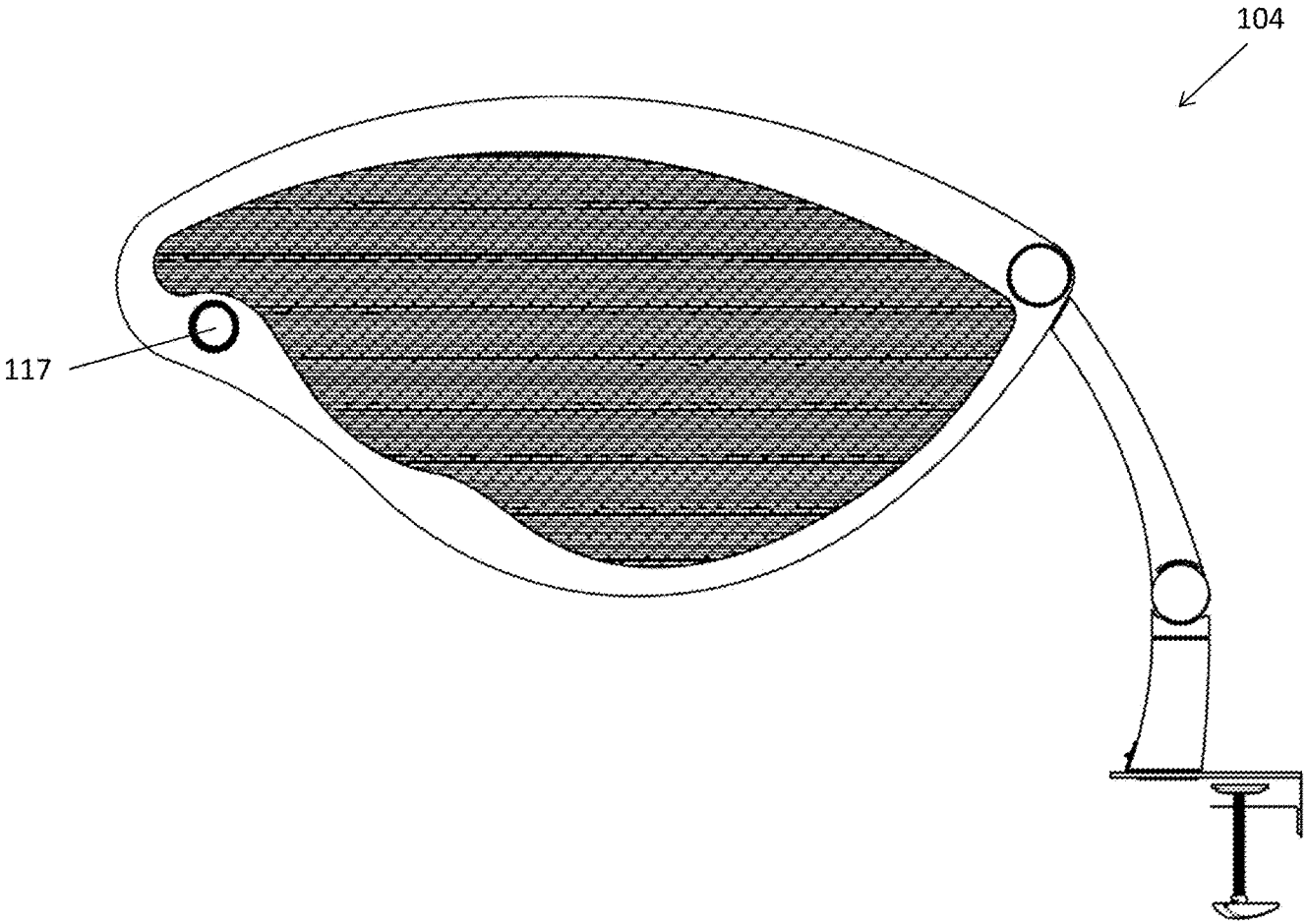
FIGS. 9 and 10 are side views of the visual and/or acoustic privacy feature shown in FIG. 7.
Figure 10:
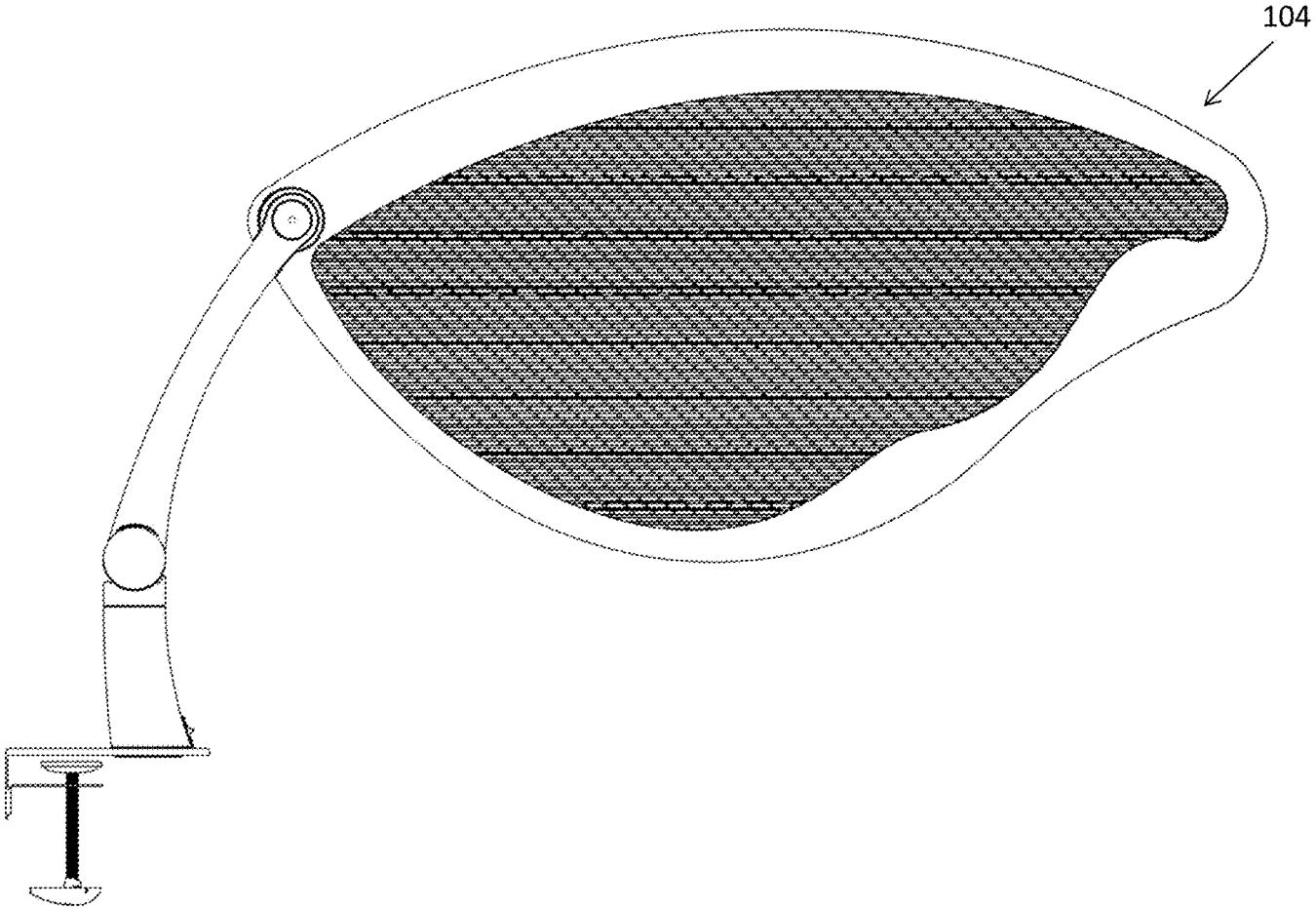
Figure 11:
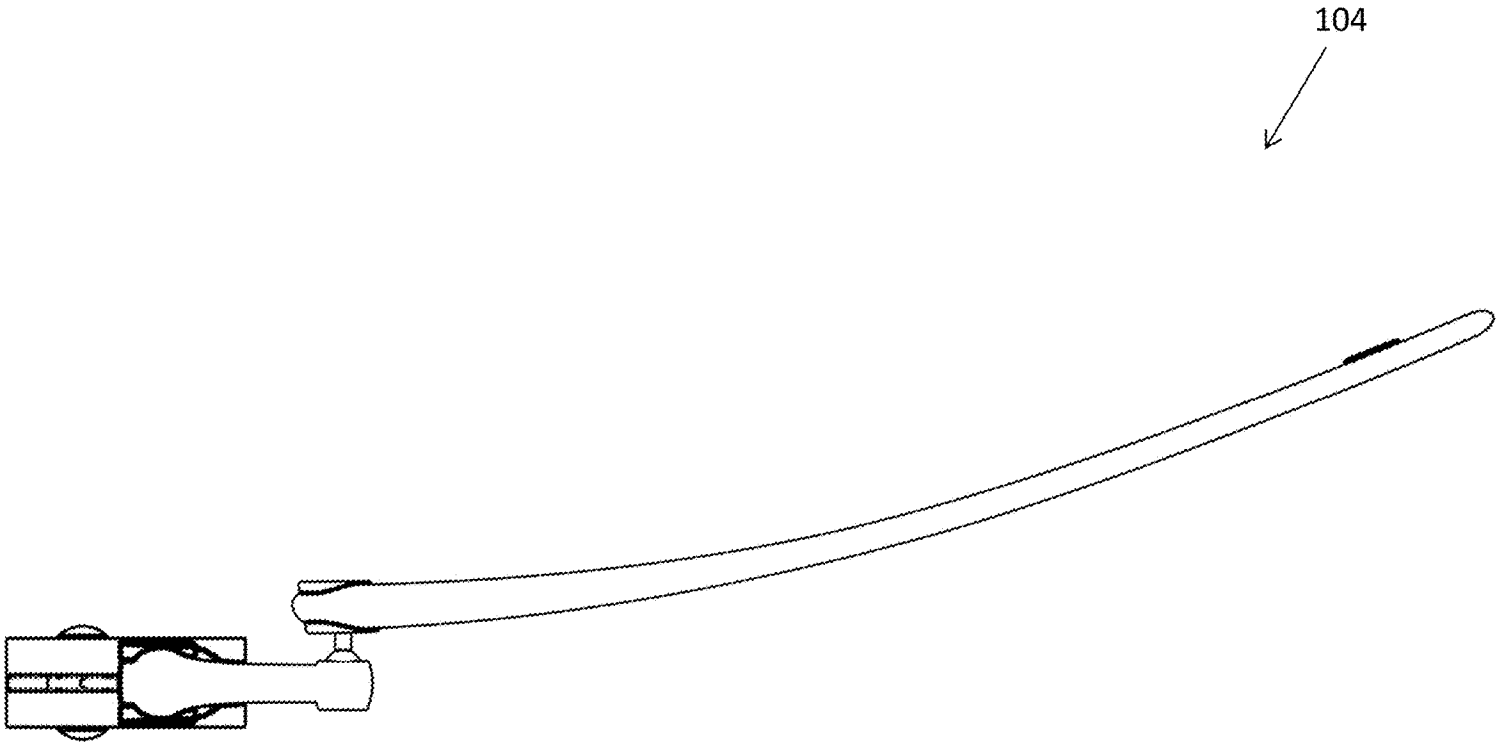
FIG. 11 is a top view of the visual and/or acoustic privacy feature shown in FIG. 7.

FIG. 6 illustrates the various components of the visual and/or acoustic privacy feature 104 according to an exemplary embodiment. As shown, the visual and/or acoustic privacy feature 104 includes a panel or screen element 116 supported by a frame 118. The frame 118 is coupled to a support arm or member 120 via a first rotatable joint or connection 124 (e.g., 360 degree ball joint, etc.). The first joint 124 preferably allows the frame 118 to be rotated or pivoted 360 degrees relative to the support arm 120.

The support arm 120 is coupled to a base 128 via a second rotatable joint or connection 132. The second joint 132 preferably allows the support arm 120 to be rotated or pivoted clockwise or counterclockwise 180 degrees relative to the base 128.

The base 128 may be mountable to the desk top 112 via a bracket 136 and clamping mechanism 140. The clamping mechanism 140 may be mechanically fastened (e.g., with screws, etc.) to the bracket 136. Then, the thumb screw portion of the clamping mechanism 140 may be rotated to thereby create a clamping force between the clamping mechanism 140 and bracket 136 for mounting to the desk top 112. Alternative embodiments may include different means for supporting or mounting the visual and/or acoustic privacy features 104, 108.

The visual and/or acoustic privacy feature 108 may include the same or similar components as the visual and/or acoustic privacy feature 104. Accordingly, the visual and/or acoustic privacy feature 108 may also include a panel or screen element 116, frame 118, support arm 120, first rotatable joint or connection 124, base 128, second rotatable joint or connection 132, bracket 136, and clamp 140.

A wide range of materials may be used for various components of the visual and/or acoustic privacy features 104, 108. By way of example, the movable acoustic and/or visual privacy panels or screens 116 may comprise mesh fabric, metal, plastic, wood, acrylic (e.g., frosted acrylic, etc.), vinyl, resin, nylon, marker board, monitor screen, sound soaking material, fabric, mesh, acrylonitrile butadiene styrene (ABS), polypropylene, thermoplastic and/or 3D printed material, etc. In exemplary embodiments, the panels or screens 116 are not electronic, e.g., not electronic computer display screens or monitors, etc. The frame 118, support arm 120, base 128, joints 124 and 132 may each be made of the same material or made of different materials from each other and/or the panels or screens 116. For example, the frame 118, support arm 120, base 128, joints 124 and 132 may be made of acrylonitrile butadiene styrene (ABS), plastic, polypropylene, metal, aluminum, stainless steel, wood, acrylic, vinyl, resin, nylon, thermoplastic and/or 3D printed material, etc.

The panels 116 may also be made out of a material that provides sound soaking ability but not necessarily, as the speakers 117 (e.g., wireless speakers, hardwired speakers, other sound producing means, etc.) provide the ability to add sound masking at the individual. The panels 116 are configured to provide visual privacy and thereby limit visual distraction. In this illustrated embodiment, the panels 116 comprise mesh, which allows the user to at least partially see through the panels 116. In other exemplary embodiments, the panels 116 comprise other materials that are clear, transparent, or translucent materials and/or configured (e.g., perforated, include one or more cut-out portions or openings, etc.) to allow the user to be at least partially visible therethrough.

Figure 5:
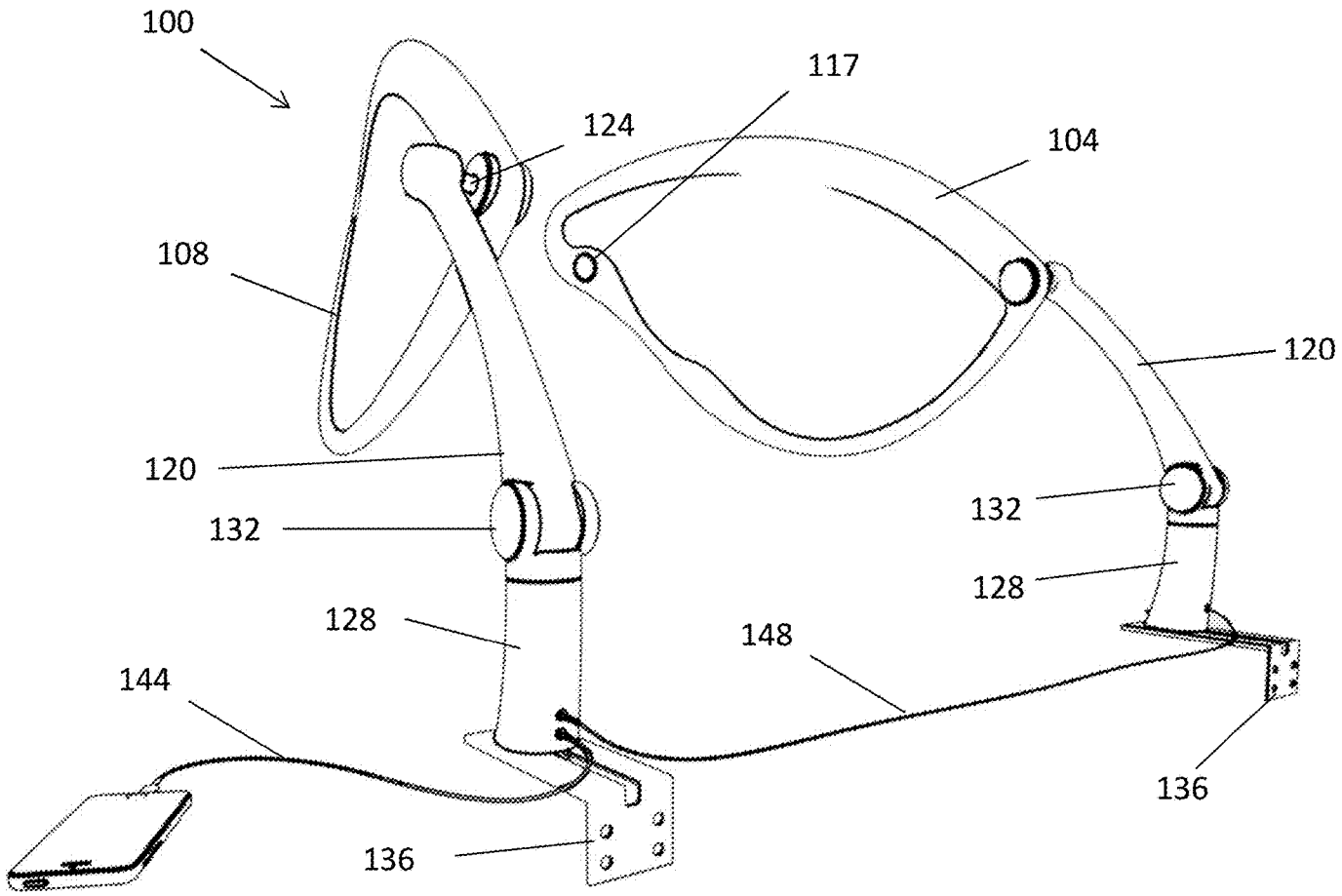
FIG. 5 is a perspective view of the visual and/or acoustic privacy features shown in FIG. 4 and also illustrating the exemplary brackets for attachment to a desk via mechanical fasteners according to an exemplary embodiment.

FIG. 5 shows wires 144, 148 passing through holes in the base 128. In this example, the wire 144 is connected to an external device, e.g., a smartphone with music to be played by speakers 117. The wire 148 connects the speakers 117 together. There may also be a charging means (e.g., an AC adapter port, a jack hole, etc.) on either or both of the visual and/or acoustic privacy features 104, 108 for charging an electronic device (e.g., a Bluetooth device, etc.) when applicable. In this example, the speakers 117 are shown hardwired to each other and to a smartphone. In other exemplary embodiments, the speakers may be wirelessly connected to each other and/or to the smartphone, e.g., via Bluetooth, etc.

Additionally or alternatively, either or both visual and/or acoustic privacy features 104, 108 may be configured to be operable as a docking station for computer equipment, such that smartphones, tablets, etc. may be plugged in for power and/or stereo speakers may be run wirelessly or wires may be run under the desktop, table, countertop, or other surface supporting the visual and/or acoustic privacy features 104, 108.

Accordingly, the visual and/or acoustic privacy features 104, 108 may thus be usable akin to headphones but which are not placed directly on the user's head. This advantageously allows the user to be aware of the surroundings, while also allowing visual and/or acoustic privacy. For example, the movable panel or screen elements 116 reduces visual distractions to the user, allows the user to focus better (e.g., on a computer monitor, etc.), and/or provide sound masking and/or music (e.g., via built in speakers 117, etc.) when positioned accordingly. The user also has the ability to selectively adjust the positioning of the movable panel or screen elements 116 into any number of different positions (e.g., to perhaps avoid a claustrophobic feeling of being closed in, etc.) while still having freedom of motion. The movable screens or panels 116 have an acoustic nature and can act as speakers/headphones without being applied to the head, such that the user is able to have privacy.

In some exemplary embodiments, movable pads may be mounted to a support surface via flexible conduits or members that allow the movable pads to be movable or positionable generally about the user's head so as to act as a visual screen, where the pads may also have white noise and/or speaker capability. The pads may have a microphone and a speaker such that the pads are usable as or with a phone device, which pads also offer visual privacy. The moveable pads may provide sound masking and/or personal music selection. Unlike a loud speaker sitting on a desk that disrupts others nearby, the inventor's visual and/or acoustic privacy features may allow a user to listen to music without disrupting others nearby. The inventor's visual and/or acoustic privacy features may thus provide visual and acoustic privacy as well as telephone operation in some exemplary embodiments. In some exemplary embodiments, the inventor's visual and/or acoustic privacy features may comprise one or more pads that are operable as visual blinders as well as a speaker "floating" or suspended from a flexible conduit. The movable pads may allow the user to have and create a personal, more private environment in the open office setting.

Exemplary embodiments are also disclosed herein of chairs having visual and/or acoustic privacy features configured to acoustically dampen, muffle, or deaden both incoming sound (e.g., surrounding sound from coworkers conversations, paper shuffling, typing, etc.) and outgoing sound (e.g., the chair user's voice when speaking on the telephone, etc.). The visual and/or acoustic privacy features may comprise a visual screen having white noise and speaker capability.

In some exemplary embodiments, the chair is reconfigurable between at least a first configuration and a second configuration. In the first configuration, the chair's visual and/or acoustic privacy features are not visible (e.g., removed, retracted, stowed, etc.) such that the chair may appear as a typical or conventional chair (e.g., wingback chair, traditional office or task chair, etc.) without any visible visual and/or acoustic privacy features. But in the second configuration, the chair's visual and/or acoustic privacy features are visible and usable (e.g., attached, extended, deployed, etc.) for acoustically dampening incoming and outgoing sound.

By way of example, the visual and/or acoustic privacy features may comprise wings, flaps, covers, panels, and/or portions at the ear level and mouth level. The visual and/or acoustic privacy features may be fully and/or partially retractable, pivotable, slidable, hinged, foldable, pliable, nesting, adjustable, removable from and reattachable to a chair or other furniture piece, fixedly attached to the chair or other furniture piece, etc. Accordingly, additional aspects of the present disclosure relate to fold away, retractable, removable, or slidable visual and/or acoustic privacy features that provide audible privacy (e.g., acoustic dampening, etc.) and visual privacy to a user. For example, an exemplary embodiment includes fully retractable visual and/or acoustic privacy features coupled to a chair headrest such that the visual and/or acoustic privacy features can be slid, pivoted, or folded away behind, inside, concealed by, or "blend" in with the chair headrest when not in use.

Some exemplary embodiments may also include a mouth piece or acoustic dampening portion at the mouth level as an option to offer more sound deadening characteristics. Alternative exemplary embodiments, however, may not include this mouth piece option and/or may include one or more visual and/or acoustic privacy features fixedly attached and not readily removable from the chair or other furniture piece.

A wide range of materials may be used for the visual and/or acoustic privacy features in exemplary embodiments, such as fabric, foam, plastic, leather, plexiglass, vinyl, metal, mesh, wood, acrylic, resin, nylon, acrylonitrile butadiene styrene (ABS), polypropylene, thermoplastic and/or 3D printed material, etc., which materials may be clear or transparent, frosted or translucent, or opaque, etc. For example, the interior of the visual and/or acoustic privacy features may include a suitable sound dampening or redirecting material (e.g., a sound soaking foam, fabric, perforated metal, acrylic, other suitable materials, etc.). An exterior of the visual and/or acoustic privacy features may comprise the same material (e.g., leather, vinyl, etc.) that is used to make the chair headrest, seat, backrest, arms, etc. so that the visual and/or acoustic privacy features may blend in as just another option on a seating line.

In some embodiments, the visual and/or acoustic privacy features may be made of a clear or transparent acrylic or plexiglass material such that the user remains visible even when after the visual and/or acoustic privacy features are closed and in the second configuration. Or, for example, the visual and/or privacy features may be other clear, transparent, or translucent materials and/or configured (e.g., perforated, include one or more cut-out portions or openings, etc.) to allow the user to be at least partially visible therethrough. These exemplary embodiments may allow a boss or supervisor to see through the visual and/or acoustic privacy features when closed, for example, to visually confirm that the user is working on company business and not surfing the internet, etc. Additionally, or alternatively, the visual and/or acoustic privacy features may be made of a soft or cushioned material for user comfort when the user's head is laying there against it, e.g., taking a nap, etc.

Figure 12B:
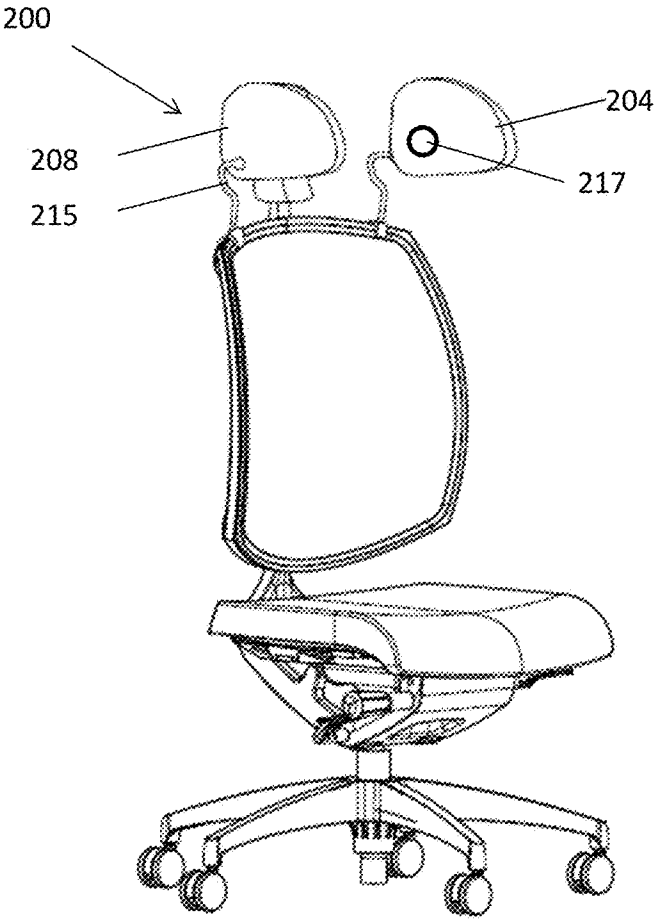
FIGS. 12A and 12B are perspective front views of a wheeled office chair having visual and/or acoustic privacy features, which are shown in a first configuration (FIG. 12A) and in a second configuration (FIG. 12B) according to an exemplary embodiment.
Figure 12A:
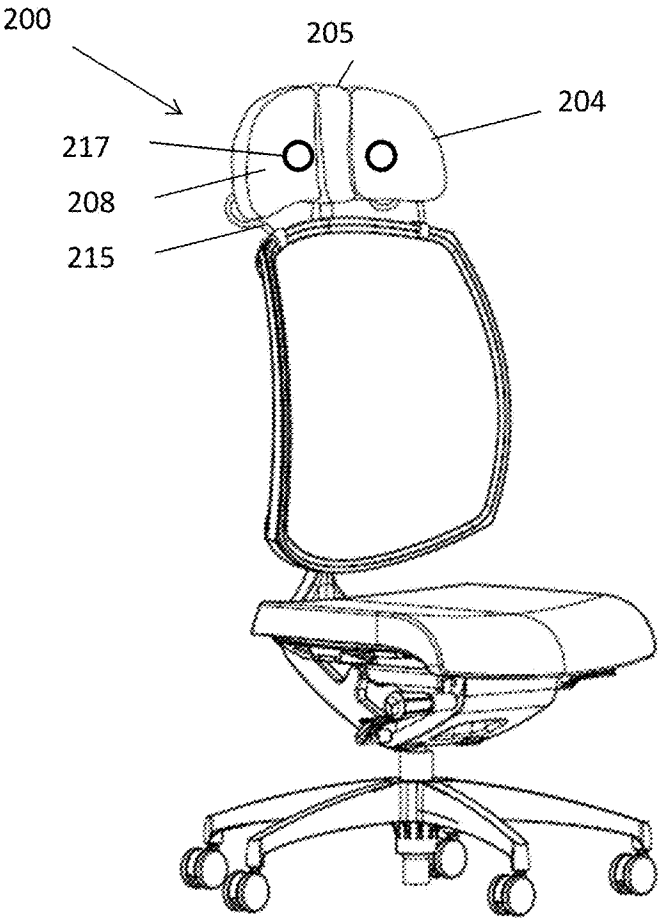

FIGS. 12A and 12B illustrate an exemplary embodiment 200 including a chair having visual and/or acoustic privacy features 204, 208 embodying one or more aspects of the present disclosure. The visual and/or acoustic privacy features 204, 208 comprise movable pads that are mounted to the chair via flexible conduits or members 215 that allow the movable pads to be movable, positionable, or reconfigurable generally about the user's head between at least a first configuration (FIG. 12A) and a second configuration (FIG. 12B).

In the first configuration, the pads are adjacent and/or nest with the headrest 205, such that the pads may become or function as part of the chair's headrest 205. In the second configuration, the movable pads are adjacent the user's head and thus may operate as visual screens or blinders, e.g., for better screen concentration, etc.

The flexible conduits 215 may also allow the pads to be positioned up in the air above the headrest. The flexible conduits 215 (e.g., or wire, glide hardware, etc.) may be mounted via universal clips or be integrated into the chair design.

The pads may also have white noise and/or speaker capability. For example, Bluetooth wireless or hard wired speakers 217 may be coupled to or in the pads. The speakers

217 may function in stereo to act as speakers, a phone device, and/or provide individual sound masking. The sound system may be user controlled, controlled by an overriding system with safety precautions, etc.

The movable pads may comprise fabric, plastic, vinyl, glass, plexiglass, metal, mesh, foam, leather, acrylic, resin, nylon, acrylonitrile butadiene styrene (ABS), polypropylene, thermoplastic and/or 3D printed material, etc. Signage or labels may be applied at either or both sides to offer brand identification. The color, shape, texture, etc. of the pads may vary.

Figure 13B:
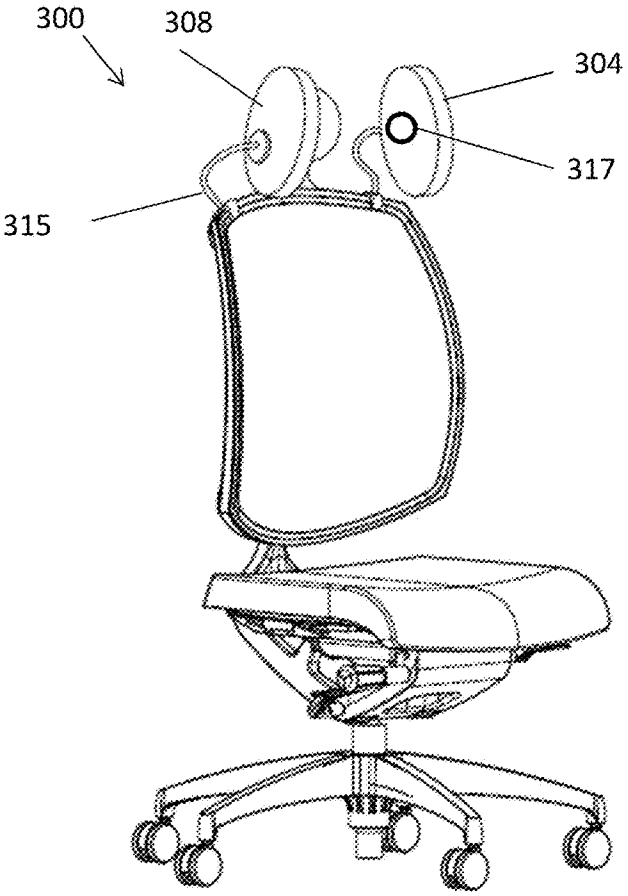
FIGS. 13A and 13B are perspective front views of a wheeled office chair having visual and/or acoustic privacy features, which are shown in a first configuration (FIG. 13A) and in a second configuration (FIG. 13B) according to an exemplary embodiment.
Figure 13A:
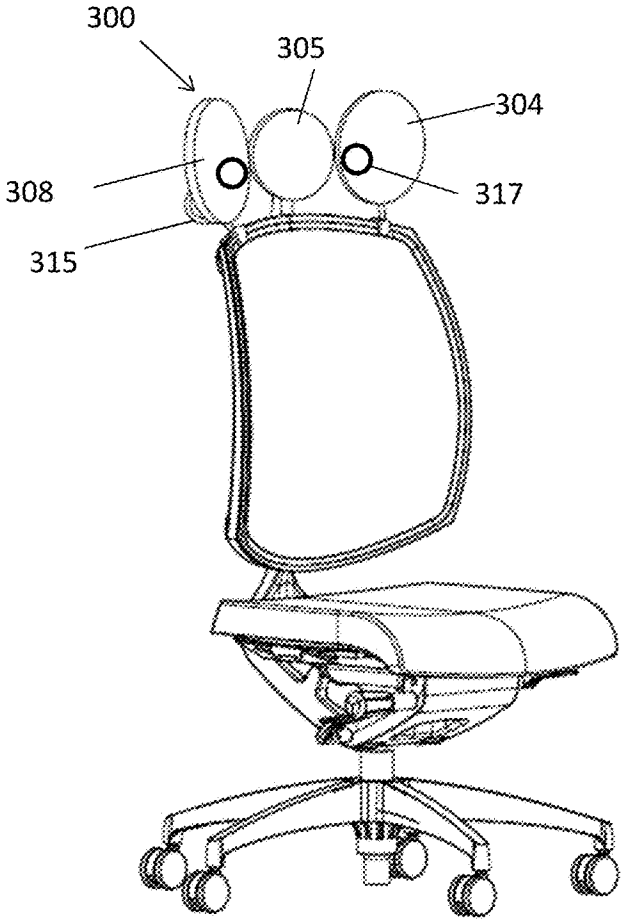

FIGS. 13A and 13B illustrate an exemplary embodiment 300 including a chair having visual and/or acoustic privacy features 304, 308 embodying one or more aspects of the present disclosure. The visual and/or acoustic privacy features 304, 308 comprise movable pads that are mounted to the chair via flexible conduits 315 that allow the movable pads to be movable, positionable, or reconfigurable generally about the user's head between at least a first configuration (FIG. 13A) and a second configuration (FIG. 13B).

In the first configuration, the pads are adjacent and/or nest with the headrest 305. In the second configuration, the movable pads are adjacent the user's head and thus may operate as visual screens or blinders, e.g., for better screen concentration, etc.

The pads may also have white noise and/or speaker capability. For example, Bluetooth wireless or hard wired speakers 317 may be coupled to or in the pads. The speakers 317 may function in stereo to act as speakers, a phone device, and/or provide individual sound masking.

Figure 14B:
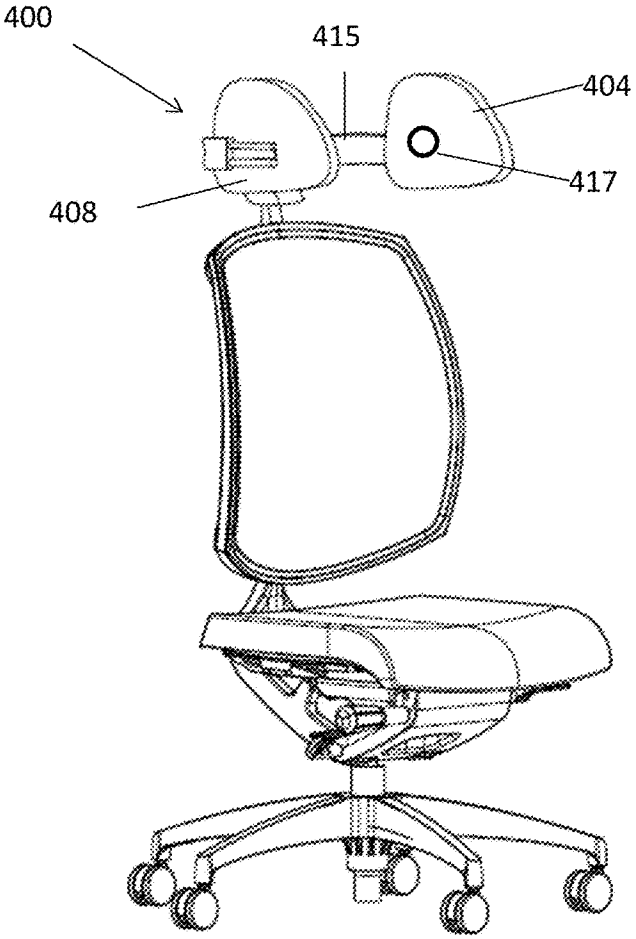
FIGS. 14A and 14B are perspective front views of a wheeled office chair having visual and/or acoustic privacy features, which are shown in a first configuration (FIG. 14A) and in a second configuration (FIG. 14B) according to an exemplary embodiment.
Figure 14A:
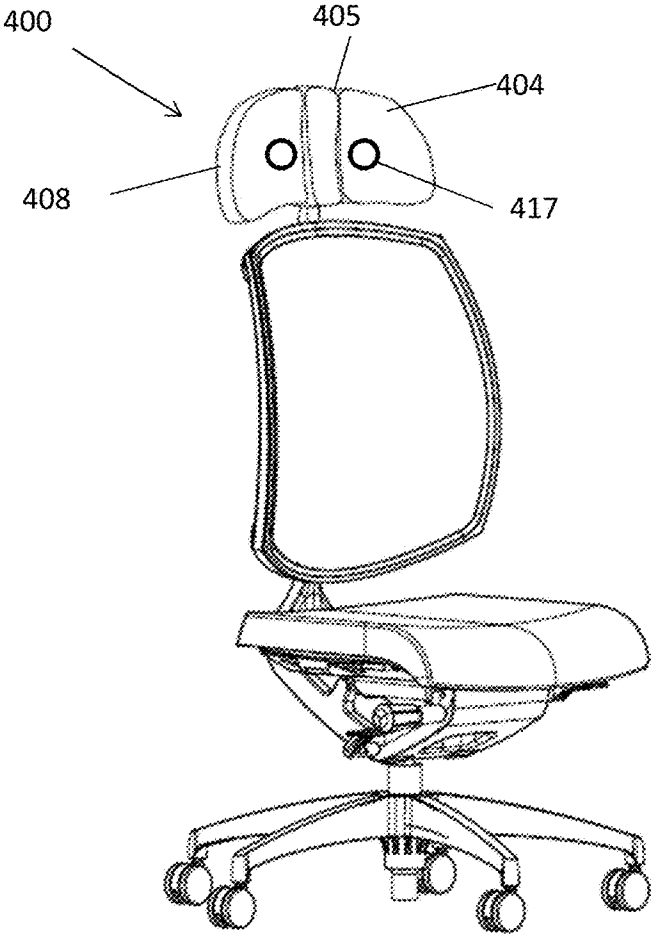

FIGS. 14A and 14B illustrate an exemplary embodiment 400 including a chair having visual and/or acoustic privacy features 404, 408 embodying one or more aspects of the present disclosure. The visual and/or acoustic privacy features 404, 408 comprise movable pads that are mounted to the chair via flexible conduits 415 that allow the movable pads to be movable, positionable, or reconfigurable generally about the user's head between at least a first configuration (FIG. 14A) and a second configuration (FIG. 14B).

In the first configuration, the pads are adjacent and/or nest with the headrest 405, such that the pads may become or function as part of the chair's headrest 405. In the second configuration, the movable pads are adjacent the user's head and thus may operate as visual screens or blinders, e.g., for better screen concentration, etc.

The flexible conduits 415 may also allow the pads to be positioned up in the air above the headrest. The flexible conduits 415 (e.g., or wire, glide hardware, etc.) may be mounted via universal clips or be integrated into the chair design.

Figure 15B:
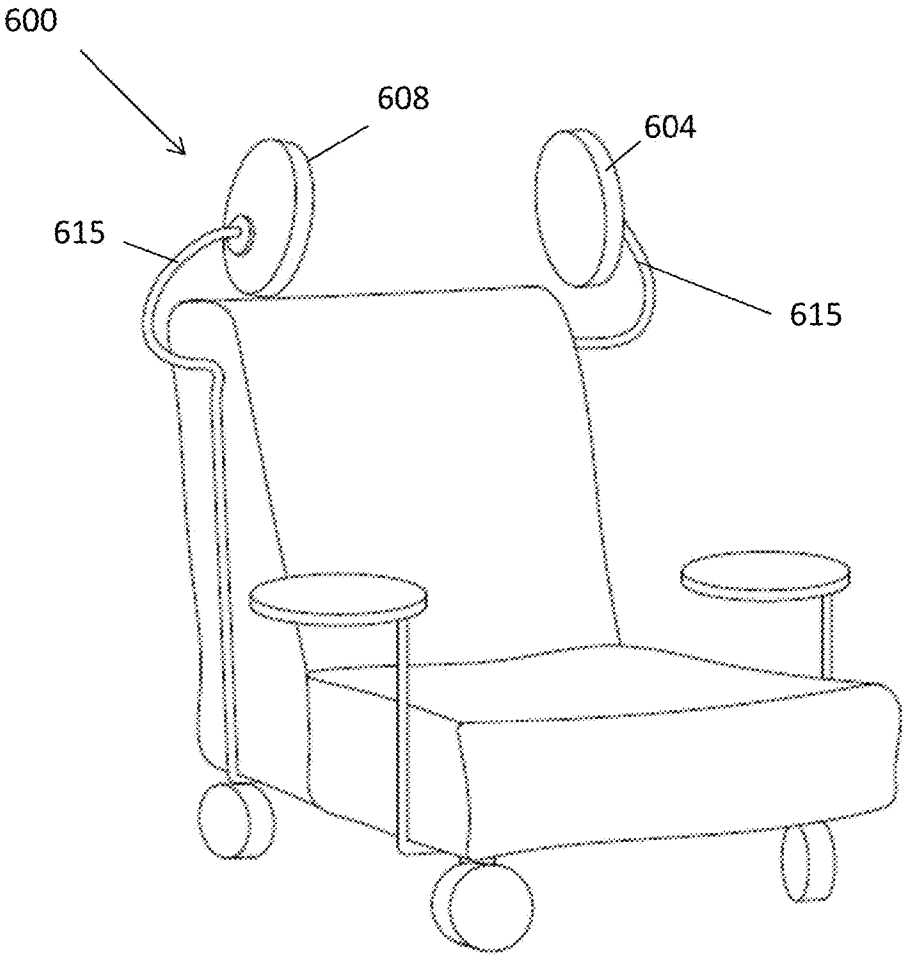
FIGS. 15A and 15B are perspective front views of cushioned chairs having visual and/or acoustic privacy features according to exemplary embodiments.
Figure 15A:
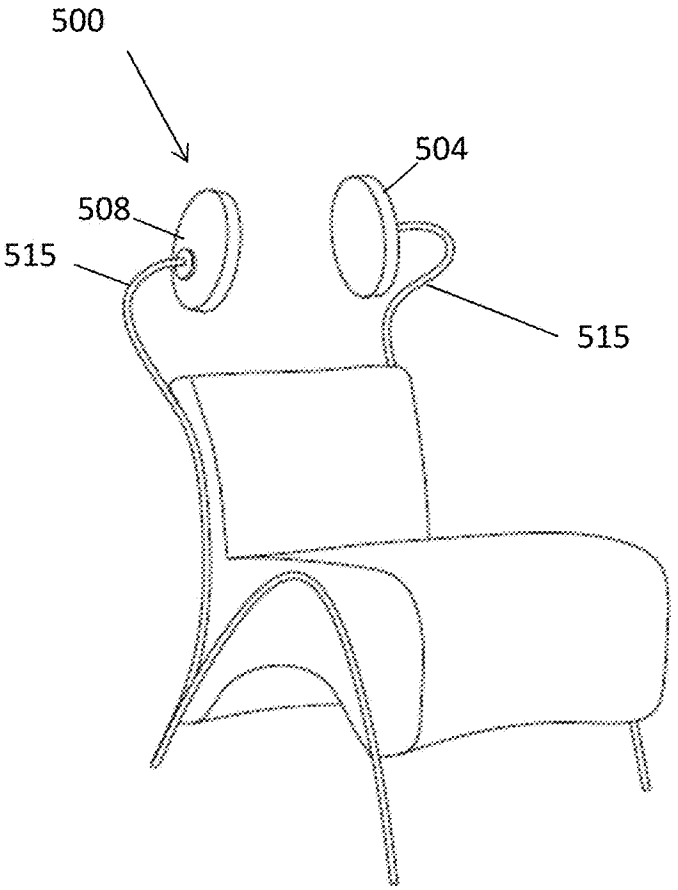

The pads may also have white noise and/or speaker capability. For example, Bluetooth wireless or hard wired speakers 417 may be coupled to or in the pads. The speakers 417 may function in stereo to act as speakers, a phone device, and/or provide individual sound masking. The sound system may be user controlled, controlled by an overriding system with safety precautions, etc. The movable pads may comprise fabric, plastic, vinyl, glass, plexiglass, metal, foam, leather, mesh, wood, acrylic, resin, nylon, acrylonitrile butadiene styrene (ABS), polypropylene, thermoplastic and/or 3D printed material, etc., FIGS. 15A and 15B illustrate exemplary embodiments 500, 600 including chairs having visual and/or acoustic privacy features 504, 508, 604, 608, respectively, embodying one or more aspects of the present disclosure. The visual and/or acoustic privacy features 504, 508, 604, 608 comprise movable pads that are mounted to or adjacent the chair via flexible conduits 515, 615 that allow the movable pads to be movable, positionable, or reconfigurable generally about the user's head between at least first and second configurations.

Figure 16:
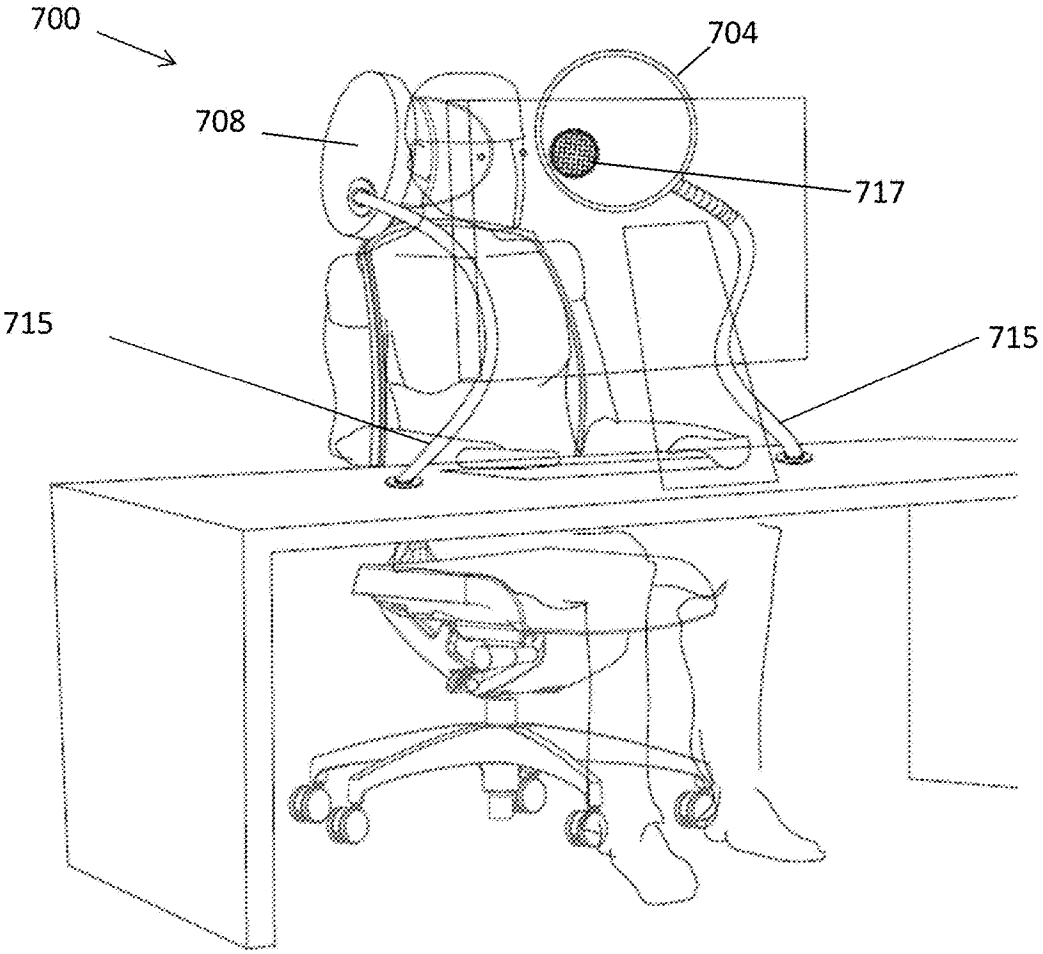
FIG. 16 is a perspective view showing visual and/or acoustic privacy features mounted to and/or supported by a desk according to an exemplary embodiment.

FIG. 16 illustrates visual and/or acoustic privacy features 704, 708 that are mounted to and/or supported by a desk according to an exemplary embodiment 700 embodying one or more aspects of the present disclosure. The visual and/or acoustic privacy features 704, 708 comprise movable pads that are mounted to or adjacent the chair via flexible conduits 715 that allow the movable pads to be movable, positionable, or reconfigurable generally about the user's head between at least first and second configurations.

The user may affect the visual privacy and sound masking by simply moving the user's head. Or, the pad can be moved completely out of the way if not needed for periods of time.

The flexible conduit or post 715 may be mounted via a grommet attachment, clamp, or table top stand rest or a combination of a docking unit. The pads may swivel about the connection to modify the speaker 717 location depending upon the mount location.

FIG. 17 illustrates exemplary embodiments 800, 900, 1000, 1100, 1200, 1300, and 1400 that include visual and/or acoustic privacy features embodying one or more aspects of the present disclosure. As shown, the size of the visual and/or acoustic privacy features may be similar in size to the size of an adult human hand, which size is sufficient to offer a blinder for the eyes and muffle or dampen sounds at the ears. Or, for example, the size of the visual and/or acoustic privacy features may be smaller than or larger than the size of an adult human hand or Ping-Pong paddle in other embodiments. For example, another exemplary embodiment includes visual and/or acoustic privacy features comprising small puck-shaped elements and/or small speakers on the ends of long conduits for delivering sound. The visual and/or acoustic privacy features may be positioned at each side of a computer monitor to provide speaker capability located at ear level for better acoustics as compared to speakers that are merely sitting on a desk top far below ear level.

The visual and/or acoustic privacy features may come in various shapes (e.g., circular 800 or 1400, lima bean shaped 1000, elliptical 1100 or 1200, trapezoidal 1300, rectangular, etc.). For example, the lima beam shape 1000 allows the speaker to be at the ear while the bulk of the shape acts as a visual screen and also provides a good location for mouth pick up for phone use. The positioning of the visual and/or acoustic privacy features 1000 may also operate as a visual cue. For example, a balloon position in which the visual and/or acoustic privacy features are positioned vertically or above the user may indicate that the user is open for conversation. As another example, a heads down position in which the visual and/or acoustic privacy features are positioned adjacent the user's head may indicate that the user is tasking and does not wish to be disturbed. As a further example, an exemplary embodiment disclosed herein may include one or more lights (e.g., light emitting diodes (LEDs), etc.) for decorative purposes and/or to provide visual cues (e.g., do not disturb, open for conversation, etc.).

The visual and/or acoustic privacy features may be rotatable to allow for various configurations. The mounting assembly (e.g., universal mount, clamp 800, 1000, 1100, desk top stand 900, 1200, etc.) may be provided with an AC adapter or other charging device, e.g., for charging an electronic device (e.g., a Bluetooth device, etc.) when applicable. The visual and/or acoustic privacy features may be configured to swivel at the base to provide sound masking to the space, e.g., for a private conversation. For example, an exemplary embodiment of the visual and/or acoustic privacy features may be configured to send or transmit sound from the user's space to thereby scramble the user's voice and produce white noise. In this exemplary embodiment, the visual and/or acoustic privacy features may thus provide a reversible system in which the user is isolated and has privacy from others and the user's actions (e.g., telephone conversations, etc.) are isolated and private (e.g., inaudible, imperceptible, etc.) from others.

FIG. 18 illustrates an exemplary embodiment 1500 that includes visual and/or acoustic privacy features 1504, 1508 mounted to and/or supported by a desk according to an exemplary embodiment embodying one or more aspects of the present disclosure. The visual and/or acoustic privacy features 1504, 1508 comprise movable pads that are mounted to or adjacent the chair via flexible conduits 1515 that allow the movable pads to be movable, positionable, or reconfigurable generally about the user's head between at least first and second configurations. In the second configuration, the front extended portion of the pads may operate as visual blinders to cut down the peripheral visual distractions.

The flexible conduits or supports 1515 may be mounted via universal clips, post grommets, desk top pedestals, etc. Alternatively, the flexible conduits or supports 1515 may be an integral part of a furniture piece, wall tool bars, etc.

FIG. 19 illustrates an exemplary embodiment 1600 including a chair having visual and/or acoustic privacy features 1604, 1608 embodying one or more aspects of the present disclosure. As shown in FIG. 19, the visual and/or acoustic privacy features 1604, 1608 comprise curved or arcuate acoustic wings or panels that are retractable (e.g., slidable into a head rest sleeve 1605, etc.) such that the chair can function and appear as a normal task chair. Alternatively, either or both of the acoustic wings may be foldable out of the way via hinged connections or be fixed and not movable relative to the chair or relative to each other, etc.

In this illustrated embodiment, the visual and/or acoustic privacy features 1604, 1608 comprise a sound acoustic panel portion 1609 at the ear level and a sound acoustic panel portion 1611 at the mouth level. The sound acoustic panel portion 1611 at the mouth level is positionable over or adjacent to the user's mouth for covering the user's mouth to muffle speaking. For example, the sound acoustic panel portion 1611 may be moved in front of the user's mouth when on the telephone.

The sound acoustic panel portion 1611 at the mouth level may also be movable out of the way, for example, to allow the user better viewing of a computer monitor, desktop, etc. Accordingly, the user may choose whether or not to use the visual and/or acoustic privacy features 1604, 1608. In addition to having the ability to move the mouth cover away from the user's mouth to provide better viewing, the acoustic wings may also be tiered in this illustrated embodiment to allow a better field of vision.

The visual and/or acoustic privacy features 1604, 1608 shown in FIG. 19 (and/or in other exemplary embodiments disclosed herein) may be made from a wide range of materials such as fabric, foam, plastic, leather, vinyl, metal, etc., which materials may be clear or transparent, frosted or translucent, or opaque, etc. For example, the interior of the sound acoustic panels 1609, 1611 may be made from a sound soaking foam, fabric, perforated metal, acrylic, mesh, other suitable materials, etc. An exterior of the sound acoustic panels may comprise the same material (e.g., leather, vinyl, etc.) that is used to make the chair headrest, seat, backrest, arms, etc.

FIG. 20 illustrates another exemplary embodiment 1700 of a chair having visual and/or acoustic privacy features 1704, 1708 embodying one or more aspects of the present disclosure. As shown in FIG. 20, the visual and/or acoustic privacy features 1704, 1708 are acoustic screen panels, wings, or flaps that are retractable (e.g., slidable into a head rest sleeve, foldable out of the way via hinged connections, etc.) such that the chair can function and appear as a normal task chair.

FIG. 20 illustrates one acoustic panel 1708 retracted into an opening in the headrest 1705, and the other acoustic panel 1704 fully extended after being slid out of the opening in the opposite side of the headrest. Alternatively, either or both of the acoustic panels may be fixed and not movable relative to the chair or relative to each other.

In this illustrated embodiment, the visual and/or acoustic privacy features 1704, 1708 comprise a sound acoustic portion 1709 at the ear level and a sound acoustic portion 1711 at the mouth level. The sound acoustic portion 1711 at the mouth level is hinged to the sound acoustic portion 1709 at the ear level. Thus, the sound acoustic portion 1711 at the mouth level can be hingedly moved or pivoted relative to the sound acoustic portion 1709 towards and away from the user's mouth.

Accordingly, the sound acoustic panels 1704, 1708 are thus slidable into and out of the openings 1713 in the headrest 1705. The sound acoustic portions 1711 at the mouth level are hingedly movable or pivotable towards and away from the user's mouth. Additionally, the headrest height and headrest angle may also be adjustable to further accommodate user acoustics and visual field. The sound acoustic flaps, panels, or wings 1704, 1708 may be operable as an audible reflector when extended in front of the user.

In this illustrated embodiment (and one or more of the other disclosed embodiments), the acoustic panels, flaps, or wings may include speakers in the ear portions and/or mouth audible receivers in the mouth portions. In which case, the acoustic panels, flaps, or wings with built-in electronic speakers and receivers may thus be operable similarly as a telephone headset and speakers.

As disclosed herein, the sound acoustic panels 1704, 1708 shown in FIG. 20 (and/or in other exemplary embodiments disclosed herein) may be made from a wide range of materials such as fabric, plastic, vinyl, heather, mesh, foam, acrylic, resin, nylon, polypropylene, and/or 3D printed material, etc. The particular materials used, sizing, number of pieces, and connection methods (e.g., hinges, etc.) may depend on the degree of privacy and isolation desired. The manner in which the visual and/or acoustic privacy features may be integrated into or used with a chair or other furniture piece may vary depending on the overall design or configuration of the chair or other furniture piece (e.g., desk, etc.).

FIG. 21 illustrates another exemplary embodiment 1800 of a chair having visual and/or acoustic privacy features 1804, 1808 embodying one or more aspects of the present disclosure. As shown in FIG. 21, the visual and/or acoustic privacy features 1804, 1808 comprise acoustic panels, wings, or flaps, which may have a single-piece accordion-style, vertebrate-style, or articulated-style configuration. The acoustic panels 1804, 1808 may be retractable (e.g., slidable into a head rest sleeve 1805, foldable out of the way via hinged connections, etc.) or fixed in position.

In this illustrated embodiment, the visual and/or acoustic privacy features 1804, 1808 includes an optional mouth flap at the end of the panel. The mouth flap may be movable relative to the user's mouth. For example, the mouth flap may be hinged to the panel to allow the mouth flap to be hingedly moved or pivoted towards and away from the user's mouth. Additionally, the headrest height and headrest angle may also be adjustable to further accommodate user acoustics and visual field.

As disclosed herein, the sound acoustic panels 1804, 1808 shown in FIG. 21 (and/or in other exemplary embodiments disclosed herein) may be made from a wide range of materials such as clear or transparent materials, translucent materials, opaque materials, etc.

FIG. 22 illustrates another exemplary embodiment 1900 of a chair having visual and/or acoustic privacy features 1908 embodying one or more aspects of the present disclosure. The visual and/or acoustic privacy features may be similar to previously disclosed acoustic panels, flaps, or wings. As shown in FIG. 22, the visual and/or acoustic privacy features 1908 comprise curved or arcuate acoustic wings or panels that are retractable (e.g., slidable into a head rest sleeve 1905, etc.) such that the chair can function and appear as a normal task chair. Alternatively, either or both of the acoustic wings may be foldable out of the way via hinged connections or be fixed and not movable relative to the chair or relative to each other, etc.

In this illustrated embodiment, the visual and/or acoustic privacy features comprise a sound acoustic panel portion 1909 at the ear level and a sound acoustic panel portion 1911 at the mouth level. The sound acoustic panel portion 1911 at the mouth level is positionable over or adjacent to the user's mouth for covering the user's mouth to muffle speaking. For example, the sound acoustic panel portion 1911 may be moved in front of the user's mouth when on the telephone.

The sound acoustic panel portion 1911 at the mouth level may also be movable out of the way, for example, to allow the user better viewing of a computer monitor, desktop, etc. For example, the portion 1911 may be slidable into and out of an opening in the other portion 1909. Accordingly, the user may choose to whether or not to use the visual and/or acoustic privacy features 1908.

FIG. 23 illustrates another exemplary embodiment 2000 of a chair, (e.g., a flight chair, etc.) having visual and/or acoustic privacy features 2004, 2008 embodying one or more aspects of the present disclosure. As shown in FIG. 23, the visual and/or acoustic privacy features 2004, 2008 comprise flexible bat-like wing portions positionable at least between an open position shown in broken lines (e.g., for collaboration with coworkers, etc.) and a closed position (e.g., a privacy position for concentration and/or speaking on a telephone, etc.).

As shown in FIG. 23, the ends of the wing portions are positioned generally in front of the user in the closed position, such that the wing portions provide the user with privacy and isolation on at least the left and right sides. The wing portions are at least partially retracted along the sides of the chair in the open position to allow the user to have better viewing of and/or discussions with coworkers. In alternative embodiments, the visual and/or acoustic privacy features may form a dome or shell about the user when in the closed or second configuration.

FIGS. 24 through 34 illustrate another exemplary embodiment 2100 including privacy features 2104, 2108 embodying one or more aspects of the present disclosure. The privacy features 2104, 2108 are mounted to and/or supported by a desk 2112 in this example. Alternatively, the privacy features 2104, 2108 may be mounted to and/or supported by other support surfaces, e.g., chairs, tabletops, etc.

In this example embodiment, the privacy features 2104, 2108 are usable and reconfigurable between a plurality of configurations. In a first configuration, the privacy features 2104, 2108 are not disposed adjacent the user's ears or along opposite side of the user's head, such that the user may easily and readily interact with others. Also in the first configuration, the privacy features 2104, 2108 may provide the user with visual privacy by creating a wall or blinder in front of the desk, which, in turn, may help the user to better concentrate and not be distracted by on goings in front of the desk.

In a second configuration shown in FIGS. 24 and 25, the privacy features 2104, 2108 are deployed for use (e.g., disposed generally over, adjacent, and/or in front of the user's ears, eyes, and/or mouth, etc.) so as to provide the user with at least some visual and/or acoustic privacy and isolation from others. The privacy features 2104, 2108 are disposed generally around the user's head so as to cover the user's ears and eyes from the side. In the second configuration, the privacy features 2104, 2108 acoustically dampen incoming and/or outgoing sound and provide visual blinders. Accordingly, the features 2104, 2108 may thus provide means for acoustically dampening incoming and/or outgoing sound and providing visual blinders.

In a third configuration shown in FIGS. 24 and 25, the privacy features 2104, 2108 are positioned vertically upright so as to be at least partially above the user's eyes and computer monitor. The visual and/or acoustic privacy features 2104, 2108 may thus offer a hood effect to help control light when in the third configuration.

Additionally, or alternatively, any one of various configurations of the privacy features 2104, 2108 may be used to provide visual cues to co-workers. For example, the privacy features 2104, 2108 may be positioned in a certain configuration to visually indicate that the user is open for conversation. As another example, the privacy features 2104, 2108 in the second configuration may visually indicate that the user is tasking and does not wish to be disturbed.

FIGS. 26 through 34 illustrate the various components (e.g., speaker 2117 (FIG. 34), etc.) of the privacy feature 2108 according to an exemplary embodiment. As shown, the privacy feature 2108 includes a panel, screen, canopy, or element 2116 (e.g., acrylonitrile butadiene styrene (ABS), etc.) supported by a frame 2118 (e.g., aluminum rods connected to a coupler 2119, etc.), which, in turn, is coupled to a spine mount assembly 2121 (e.g., ABS, etc.) shown in FIG. 31. The assembly 2121 is coupled to a support arm, member, or assembly 2120 (e.g., gooseneck, handle, extension, stem, support arm, aluminum tubing, ABS end cap, etc.) shown in FIG. 30 via a connector 2124 (e.g., ABS, etc.) shown in FIG. 32.

The support arm assembly 2120 is coupled to a mounting mechanism or assembly 2123 shown in FIG. 29. The mounting mechanism 2123 includes a base 2128 shown in FIG. 33. The base 2128 may be mountable to the desk top 2112 via a bracket or mount 2136 (e.g., steel, etc.) and clamping mechanism 2140 (e.g., knob assembly, etc.). The clamping mechanism 2140 may be mechanically fastened (e.g., with screws, etc.) to the bracket 2136. Then, the thumb screw portion of the clamping mechanism 2140 may be rotated to thereby create a clamping force between the clamping mechanism 2140 and bracket 2136 for mounting to the desk top 2112. Alternative embodiments may include different means for supporting or mounting the privacy features 2104, 2108.

The privacy feature 2104 may include the same or similar components as the privacy feature 2108. Accordingly, the privacy feature 2104 may also include a panel, screen, canopy, or element 2116, frame 2118, support arm assembly 2120, mounting mechanism 2123, base 2128, bracket 2136, and clamp 2140.

A wide range of materials may be used for various components of the visual and/or acoustic privacy features 2104, 2108. By way of example, the movable privacy panels or screens 2116 may comprise mesh fabric, metal, plastic, wood, acrylic (e.g., frosted acrylic, etc.), vinyl, resin, nylon (e.g., nylon ripstop, etc.), marker board, monitor screen, sound soaking material, fabric, mesh, acrylonitrile butadiene styrene (ABS), polypropylene, thermoplastic and/or 3D printed material, etc. In exemplary embodiments, the panels or screens 2116 are not electronic, e.g., not electronic computer display screens or monitors, etc. The frame 2118 and support arm assembly 2120 may each be made of the same material or made of different materials from each other and/or the panels or screens 2116. For example, the frame 2118, support arm assembly 2120, and/or base 2128 may be made of acrylonitrile butadiene styrene (ABS), plastic, polypropylene, metal, aluminum, stainless steel, wood, acrylic, vinyl, resin, nylon, thermoplastic and/or 3D printed material, etc.

The panels 2116 may also be made out of a material that provides sound soaking ability but not necessarily, as the speakers 2117 (e.g., wireless speakers, hardwired speakers, other sound producing means, etc.) provide the ability to add sound masking at the individual. The panels 2116 are configured to provide visual privacy and thereby limit visual distraction. In this illustrated embodiment, the panels 2116 comprise mesh, which allows the user to at least partially see through the panels 2116. In other exemplary embodiments, the panels 2116 comprise other materials that are clear, transparent, or translucent materials and/or configured (e.g., perforated, include one or more cut-out portions or openings, etc.) to allow the user to be at least partially visible therethrough.

Although FIGS. 24 and 25 show the privacy features 2104, 2108 mounted to a desk, other exemplary embodiments may include the privacy features 2104, 2108 mounted to other furniture, such as an office chair, table, cubicle wall. Also, for example, the privacy features 2104, 2108 (e.g., pads, screens, pads, blinders, panels, walls, wings, flaps, non-electronic elements, other means for providing visual and/or acoustic privacy features, etc.) may be releasably attachable or mountable to, fixedly attached to, integral to, supported by, etc. a support surface of a piece of furniture, floor, ceiling, canopy, etc. As yet another example, the privacy features 2104, 2108 may be configured to be free standing devices, e.g., free standing devices on a support surface (e.g., desktop, floor, etc.) without being mounted or attached to the support surface.

FIG. 35 illustrates another exemplary embodiment 2200 including privacy features 2204, 2208 embodying one or more aspects of the present disclosure. In this example, the privacy features 2204, 2208 are mounted within a slot or track 2227 along a work surface of a desk 2212 according to an exemplary embodiment. The track 2227 may be located at about a middle of, towards the front of, about 8 to 12 inches behind the frontmost edge of the desk, etc.

The wing portions may be made from a wide range of materials such as clear or transparent materials, translucent materials, opaque materials, fabric materials, etc. For example, the wing portions or other visual and/or acoustic privacy features may be made of a clear or transparent acrylic or plexiglass material such that the user remains visible even when after the visual and/or acoustic privacy features are closed and in the second configuration. This may allow a boss or supervisor to see through the visual and/or acoustic privacy features when closed, for example, to visually confirm that the user is working on company business and not surfing the Internet, etc.

The size of the visual and/or acoustic privacy features relative to the size of the chair or other piece of furniture may also vary depending on the overall size of the chair or other piece of furniture, desired level of visual and/or acoustic privacy. Accordingly, the relative sizing of the visual and/or acoustic privacy features to the chairs or other furniture pieces and the particular configurations shown in FIGS. 1 through 35 are non-limiting examples only as the visual and/or acoustic privacy features disclosed herein may be usable with any suitable type of chair, table, desk, or other furniture piece. Moreover, the particular materials used, sizing, number of pieces, and connection methods (e.g., hinges, etc.) may depend on the degree of privacy and isolation desired. Also, the manner in which the visual and/or acoustic privacy features are integrated into, attached to, or supported by a chair or other furniture piece may vary depending on the overall design or configuration of the chair or furniture piece.

The shape and color of the visual and/or acoustic privacy features may also vary. For example, the visual and/or acoustic privacy features (e.g., screen, etc.) may be very large to offer a much more private setting in some exemplary embodiments. As another example, the visual and/or privacy features may be relatively small, e.g., about the size of or slightly larger than an adult human hand extended, etc. The visual and/or acoustic privacy features may be provided in different colors. For example one office department may include only red colored visual and/or acoustic privacy features while another office department includes blue colored visual and/or acoustic privacy features, thus allowing the two different departments to be easily recognized and distinguished from each other.

By way of example, the visual and/or acoustic privacy features may comprise an add-on feature that is retrofit to existing chairs or other existing furniture. Or, for example, the visual and/or acoustic privacy features may comprise an integral part or design of the chair or furniture piece itself. In which case, chairs or other furniture pieces may be provided to customers with visual and/or acoustic privacy features already included, pre-installed or pre-existing.

By muffling surrounding sounds and sounds on the way out, exemplary embodiments herein are thus able to create a mini-office or area of audible privacy around the user's points of source and receipt. For example, the visual and/or acoustic privacy features when deployed may be generally disposed around (e.g., surround the entire or substantial entirety of, etc.) the user's head. The creation of a "mini-office" around the user's head is unlike the manner in which traditional private offices provide privacy by completely walling off workers from each other, which tends to make collaboration more difficult. Accordingly, exemplary embodiments disclosed herein may thus allow the ability to have more people in an open office environment with less distraction with less space used while also allowing more and easier collaboration. The reconfigurable nature (e.g., removable, retractable, pivotable, slidable, hingedly movable, foldable, otherwise adjustable, etc.) of the visual and/or acoustic privacy features allow those features to be used (e.g., attached, extended, deployed, etc.) or not used (e.g., removed, retracted, stowed, moved out of the way, etc.) depending on the user's choice similar to the choice a user makes when deciding whether or not to use adjustable arms on a chair.

In addition, some exemplary embodiments also include an acoustic dampening portion that is configured to help bounce the user's own voice back to the user. Advantageously, this will allow the user to hear the user's voice better and hear how it sounds (e.g., too loud, too soft, etc.).

In some exemplary embodiments, an acoustic dampening portion at the mouth level may be reconfigurable to allow it to be pulled, pivoted, or otherwise movable in a first direction towards the user's mouth and in an opposite, second direction away from the user's mouth. For example, the acoustic dampening portion at the mouth level may be moved in the first direction towards the user's mouth to muffle the user's voice when on the phone so as to not distract adjacent coworkers. When the user hangs up the phone, the acoustic dampening portion at the mouth level may then be moved in the second, opposite direction away from the user's mouth to allow the user to more easily talk to coworkers for better collaboration therewith and/or to allow the user to have better viewing of a computer monitor, papers on a desktop, or other environment.

In some exemplary embodiments, an acoustic dampening portion at the mouth level may be movable independently from acoustic dampening portions at the ear level. In such exemplary embodiments, the acoustic dampening portion at the mouth level may be movable in the first and second directions towards and away from the user's mouth while the acoustic dampening portions at the ear level remain stationary. For example, the user may choose to have the acoustic dampening portions at the ear level remain positioned generally around the user's ears for muffling surrounding sound for better concentration when the user hangs up the phone, but may also move the acoustic dampening portion at the mouth level in the second, opposite direction away from the user's mouth to allow better viewing of a computer monitor, papers on a desktop, or other environment.

In alternative embodiments, an acoustic dampening portion at the mouth level is only movable collectively and simultaneously with acoustic dampening portions at the ear level. In such alternative embodiments, moving the acoustic dampening portion at the mouth level towards and away from the user's mouth may thus also include simultaneously moving the acoustic dampening portions at the ear level respectively towards and away from the user's ears.

In some exemplary embodiments, the visual and/or acoustic privacy features may be configured to extend outwardly from a headrest and away from the user's head in another or third configuration. In such embodiments, this third configuration may allow multiple chairs or other furniture pieces having their visual and/or acoustic privacy features in the third configuration to be positioned facing each other in, for example, a triangular, rectangular, etc. orientation. In which case, the visual and/or acoustic privacy features may cooperate to create a mini-office or area of audible privacy around the users. Thus, the users facing each other will be able to talk and collaborate with each other while the visual and/or acoustic privacy features link up and cooperate to acoustically dampen, muffle, or deaden both outgoing sound (e.g., the voices of the users of the chairs or other furniture pieces when speaking with each other, etc.) and incoming sound (e.g., surrounding sound from other coworkers conversations, paper shuffling, typing, etc.).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below." "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus comprising one or more privacy features each including:

a support member;

an element coupled to or supported by the support member;

whereby the one or more privacy features are reconfigurable into a plurality of different configurations, including at least:

a first configuration in which the element is positioned to be spaced apart from a user's head; and a second configuration in which the element is positioned to be adjacent and alongside the user's head;

wherein:

the element is not electronic; or the element comprises one or more of plastic, vinyl, acrylic, resin, nylon, marker board, acrylonitrile butadiene styrene (ABS), polypropylene, thermoplastic, 3D printed material, fabric or mesh; or the element is configured to allow the user to be at least partially visible through the element;

and wherein:

the support member comprises a flexible member operable for supporting the element above a support surface, the flexible member configured to be flexed to thereby move the element relative to the support surface between at least the first and second configurations; or the support member comprises a flexible conduit; or the apparatus further comprises one or more speakers coupled to or supported by the element.

2. The apparatus of claim 1, wherein the apparatus is mounted to or supported by a furniture piece having a front surface:

the elements are parallel to the front surface in the first configuration;

the elements are perpendicular to the front surface in the second configuration; and the elements are reconfigurable into a third configuration in which the elements are generally upright above the furniture piece whereby the elements are configured to be operable for blocking or shielding incoming light relative to a computer monitor or for providing a visual cue to others.

3. The apparatus of claim 1, wherein the support member comprises a flexible member operable for supporting the element above a support surface, the flexible member configured to be flexed to thereby move the element relative to the support surface between at least the first and second configurations.

4. The apparatus of claim 1, wherein the support member comprises a flexible conduit.

5. The apparatus of claim 1, further comprising one or more speakers coupled to or supported by the element.

6. The apparatus of claim 5, wherein the one or more speakers are configured to provide sound at ear level of the user with the privacy feature including the one or more speakers in the second configuration in which the element is adjacent and alongside the user's ears.

7. The apparatus of claim 1, wherein:

the element is not an electronic computer display screen or monitor; and the element comprises one or more of plastic, vinyl, acrylic, resin, nylon, marker board, acrylonitrile butadiene styrene (ABS), polypropylene, thermoplastic, 3D printed material, fabric or mesh; and the element is configured to allow the user to be at least partially visible through the element.

8. A furniture piece comprising the apparatus of claim 1.

9. An apparatus comprising one or more privacy features each including:

a support member;

an element coupled to or supported by the support member;

one or more speakers coupled to or supported by the element;

whereby the element is positionable relative to a user's ears with the one or more speakers positioned to provide sound to the user;

wherein:

the element is not electronic; or the element comprises one or more of plastic, vinyl, acrylic, resin, nylon, marker board, acrylonitrile butadiene styrene (ABS), polypropylene, thermoplastic, 3D printed material, fabric or mesh; or the element is configured to allow the user to be at least partially visible through the element.

10. The apparatus of claim 9, wherein the one or more privacy features are reconfigurable into a plurality of different configurations, including at least:

a first configuration in which the element is positioned to be spaced apart from the user's head; and a second configuration in which the element is positioned adjacent and alongside the user's ears with the one or more speakers positioned to provide sound at ear level of the user.

11. The apparatus of claim 10, wherein the apparatus is mounted to or supported by a furniture piece having a front surface:

the elements are parallel to the front surface in the first configuration;

the elements are perpendicular to the front surface in the second configuration; and the elements are reconfigurable into a third configuration in which the elements are generally upright above the furniture piece whereby the elements are configured to operable for blocking or shielding incoming light relative to a computer monitor or for providing a visual cue to others.

12. The apparatus of claim 9, wherein the support member comprises a flexible member operable for supporting the element above a support surface, the flexible member configured to be flexed to thereby move the element relative to the support surface.

13. The apparatus of claim 9, wherein the support member comprises a flexible conduit.

14. The apparatus of claim 9, wherein:

the element is not an electronic computer display screen or monitor; and the element comprises one or more of plastic, vinyl, acrylic, resin, nylon, marker board, acrylonitrile butadiene styrene (ABS), polypropylene, thermoplastic, 3D printed material, fabric or mesh; and the element is configured to allow the user to be at least partially visible through the element.

15. A furniture piece comprising the apparatus of claim 9.

16. An apparatus comprising:

first and second privacy means for providing privacy;

first and second mounting means for mounting the first and second privacy means to a support surface such that the first and second privacy means are movable relative to the support surface into a plurality of different configurations, including at least:

a first configuration in which the first and second privacy means are positioned to be spaced apart from a user's head; and a second configuration in which the first and second privacy means are positioned to be adjacent and alongside the user's head whereby the first and second privacy means are configured to provide the user with at least some privacy;

wherein:

the first and second mounting means comprise flexible members operable for supporting the first and second privacy means above the support surface, the flexible members are configured to be flexed to thereby move the first and second privacy means relative to the support surface between at least the first and second configurations; or the first and second mounting means comprise flexible conduits.

17. The apparatus of claim 16, wherein:

the first and second privacy means are not electronic; or the first and second privacy means comprise one or more of plastic, vinyl, acrylic, resin, nylon, marker board, acrylonitrile butadiene styrene (ABS), polypropylene, thermoplastic, 3D printed material, fabric or mesh; or the first and second privacy means are configured to allow the user to be at least partially visible through the first and second privacy means.

18. The apparatus of claim 16, further comprising first and second sound producing means coupled to or supported by the first and second privacy means, and wherein the first and second sound producing means are configured to be positioned to provide sound at ear level of the user with the first and second privacy means in the second configuration.

19. The apparatus of claim 16, wherein the apparatus is mounted to or supported by a furniture piece having a front surface:

the first and second privacy means are parallel to the front surface in the first configuration;

the first and second privacy means are perpendicular to the front surface in the second configuration; and the first and second privacy means are reconfigurable into a third configuration in which the first and second privacy means are generally upright above the furniture piece whereby the first and second privacy means are operable for blocking or shielding incoming light relative to a computer monitor or for providing a visual cue to others.

20. A furniture piece comprising the apparatus of claim 16.

* * * * *